US012677865B1

(12) United States Patent
Williams

(10) Patent No.: US 12,677,865 B1
(45) Date of Patent: Jul. 14, 2026

(54) FLUID CHAMBER MOLD AND METHOD OF USE

(71) Applicant: Glen Williams, Winthrop Harbor, IL (US)

(72) Inventor: Glen Williams, Winthrop Harbor, IL (US)

( * ) Notice: Subject to any disclaimer, the term of this patent is extended or adjusted under 35 U.S.C. 154(b) by 527 days.

(21) Appl. No.: 18/367,000

(22) Filed: Aug. 8, 2023

Related U.S. Application Data

(63) Continuation-in-part of application No. 16/683,231, filed on Nov. 13, 2019, now Pat. No. 11,856,980.

(51) Int. Cl.
*A24C 5/06* (2006.01)
*A24C 5/60* (2006.01)

(52) U.S. Cl.
CPC ..... *A24C 5/06* (2013.01); *A24C 5/605* (2013.01)

(58) Field of Classification Search
CPC .... A24C 5/00; A24C 5/02; A24C 5/06; A24C 5/42; A24C 5/40; A24C 5/39; A24C 5/002; A24C 5/54; A24C 5/474; A24C 5/46; A24D 1/022
See application file for complete search history.

(56) References Cited

U.S. PATENT DOCUMENTS

| | | | | |
|---|---|---|---|---|
| 11,856,980 | B1 * | 1/2024 | Williams | A24C 5/06 |
| 2016/0088871 | A1 * | 3/2016 | Sinclair, Jr. | A24D 1/045 131/365 |
| 2017/0332699 | A1 * | 11/2017 | Kurthy | A24F 13/24 |

* cited by examiner

*Primary Examiner* — Michael H. Wilson
*Assistant Examiner* — Stephanie Lynn Moore
(74) *Attorney, Agent, or Firm* — Schmeiser Olsen PLLC; Genna S. Hibbs

(57) ABSTRACT

This invention relates to a new way of packing smokable vessels such that an open column for the flow of air is created and greatly increases the efficiency of the smoking vessel. Variations include a more efficient way of infusing smokable material after packing into smokable vessels. This invention relates to single-use and is scalable all the way up to mass production.

19 Claims, 13 Drawing Sheets

FLUID CHAMBER MOLD AND METHOD OF USE

CROSS REFERENCE

This application is a non-provisional, continuation-in-part utility application for and claims the benefit of non-provisional application Ser. No. 16/683,231, titled, "Fluid Chamber Mold and Method of Use," filed 13 Nov. 2019, including the specification. This is a new continuation-in-part application.

BRIEF DESCRIPTION OF DRAWINGS

Non-limiting and non-exhaustive examples of several of the various embodiments of the present invention are described with references to the following figures, and reference numbers refer to the same features throughout the various views and embodiments unless otherwise specified.

FIG. 13 does not show removal of the fluid chamber mold from the open end of the smoking vessel.

FIG. 15 does not show removal of the fluid chamber mold from the open end/top of the smoking vessel.

Figure 1:
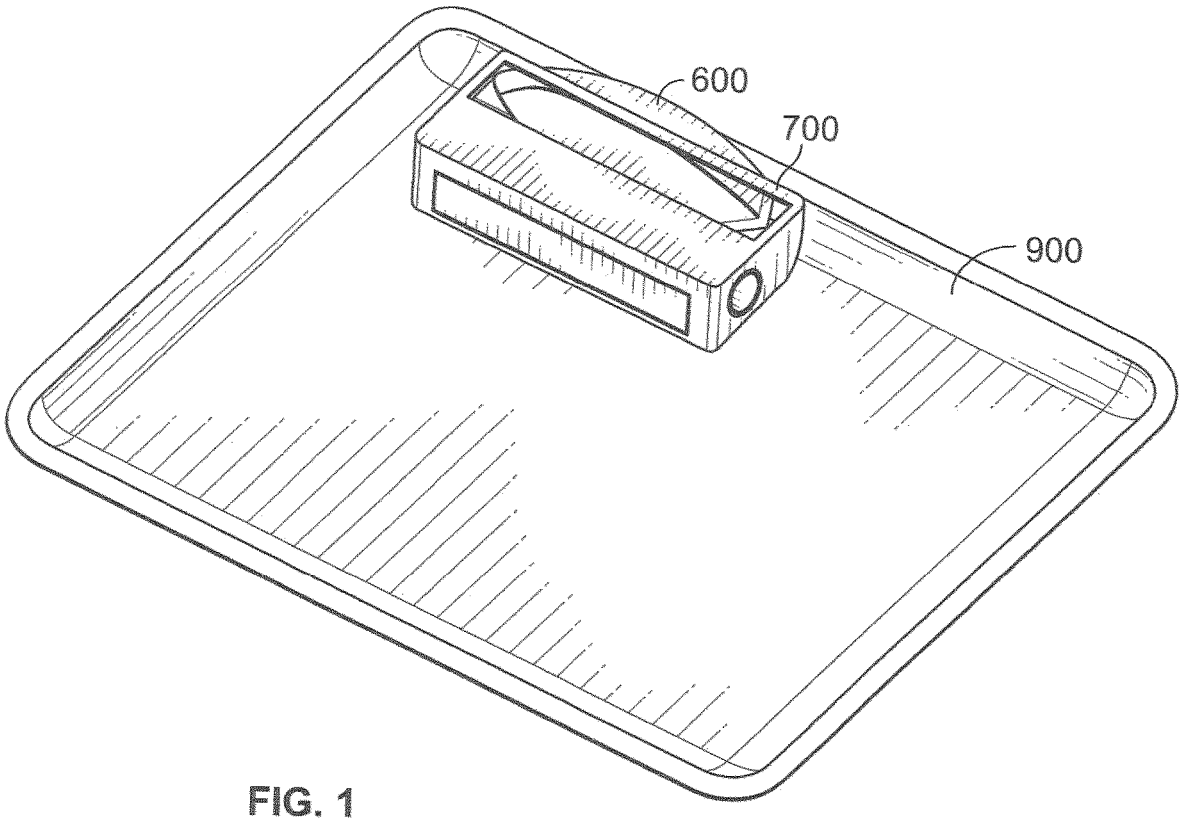
FIG. 1 is an example illustration showing the fully assembled fluid chamber mold system in material management transfer/storage with material management tool/scraper, on a tray.

Corresponding reference characters indicate corresponding components throughout the several views of the drawings. Skilled artisans will appreciate that elements in the figures are illustrated for simplicity and clarity and have not necessarily been drawn to scale. Also, common but well-understood elements that are useful or necessary in a commercially feasible embodiment are often not depicted in order to facilitate a less obstructed view of these various embodiments. Additionally, the disclosed architecture is sufficiently configurable, such that it may be utilized in ways other than what is shown.

DETAILED DESCRIPTION OF INVENTION

In this Specification, which includes the figures, claims, and this detailed description, reference is made to particular and possible features of the embodiments of the invention, including method steps. These particular and possible features are intended to include all possible combinations of such features, without exclusivity. For instance, where a feature is disclosed in a specific embodiment or claim, that feature can also be used, to the extent possible, in combination with and/or in the context of other aspects and embodiments of the invention, and in the invention generally. Additionally, the disclosed architecture is sufficiently configurable, such that it may be utilized in ways other than what is shown.

The purpose of the Abstract of this Specification is to enable the U.S. Patent and Trademark Office and the public generally, and especially the scientists, engineers and practitioners of the art who are not familiar with patent or legal terms or phrasing, to determine quickly from a cursory inspection the nature and essence of the technical disclosure of the application. The Abstract is not intended to be limiting as to the scope of the invention in any way.

In the following description, numerous specific details are given in order to provide a thorough understanding of the present embodiments. It will be apparent, however, to one having ordinary skill in the art, that the specific detail need not be employed to practice the present embodiments. On other instances, well-known materials or methods have not been described in detail in order to avoid obscuring the present embodiments. When limitations are intended in this Specification, they are made with expressly limiting or exhaustive language.

Reference throughout this Specification to "one embodiment", "an embodiment", "one example" or "an example" means that a particular feature, structure, or characteristic described in connection with the embodiment or example is included in at least one embodiment of the present embodiments. Thus, appearances of the phrases "in one embodiment", "according to an embodiment", "in an embodiment", "one example", "for example", "an example", or the like, in various places throughout this Specification are not necessarily all referring to the same embodiment or example. Furthermore, the particular features, structures, or characteristics may be combined in any suitable combinations and/or sub-combinations in one or more embodiments or examples.

The terms "comprises", "comprising", "includes", "including", "has", "having", "could", "could have" or their grammatical equivalents, are used in this Specification to mean that other features, components, materials, steps, etc. are optionally present as a non-exclusive inclusion. For instance, a device "comprising" (or "which comprises") components A, B, and C can contain only components A, B, and C, or can contain not only components A, B, and C but also one or more other components. For example, a method comprising two or more defined steps can be carried out in any order or simultaneously, unless the context excludes that possibility; and the method can include one or more other steps which are carried out before any of the defined steps, between two of the defined steps, or after all the defined steps, unless the context excludes that possibility.

Further, unless expressly stated to the contrary, "or" refers to an inclusive or and not to an exclusive or. For example, An embodiment could have optional features A, B, or C, so the embodiment could be satisfied with A in one instance, with B in another instance, and with C in a third instance, and probably with AB, AC, BC, or ABC if the context of features does not exclude that possibility.

Examples or illustrations given are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these example or illustrations are utilized will encompass other embodiments, which may or may not be given in this Specification, and all such embodiments are intended to be included within the scope of that term or terms. Language designating such nonlimiting examples and illustrations includes, but is not limited to "for example", "for instance", "etc.", "or otherwise", and "in one embodiment."

The phrase "at least" followed by a number is used to denote the start of a range beginning with that number, which may or may not be a range having an upper limit, depending on the variable defined. For instance, "at least 1" means 1 or more.

In this specification. "a" and "an" and similar phrases are to be interpreted as "at least one" and "one or more." In this specification, the term "may" or "can be" or "could be" is to be interpreted as "may, for example." In other words, the term "may" is indicative that the phrase following the term "may" is an example of one of a multitude of suitable possibilities that may, or may not, be employed to one or more of the various embodiments.

The phrase "a plurality of" followed by a feature, component, or structure is used to mean more than one, specifically including a great many, relative to the context of the component.

It is the applicant's intent that only claims that include the express language "means for" or "step for" be interpreted under 35 U.S.C. § 112. Claims that do not expressly include the phrase "means for" or "step for" are not to be interpreted under 35 U.S.C. § 112.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purpose required by law, but otherwise reserves all copyright rights whatsoever.

FIG. 1 is an example illustration of an embodiment of the fully assembled fluid chamber mold system material management transfer/storage 700 with the material management tool/scraper 600 on a tray 900. The material management transfer/storage 700 is magnetically attached to the tray 900 which provides a stable surface to assemble the different parts included in the material transfer/storage 700 to form a fluid chamber mold system 200.

Figure 2:
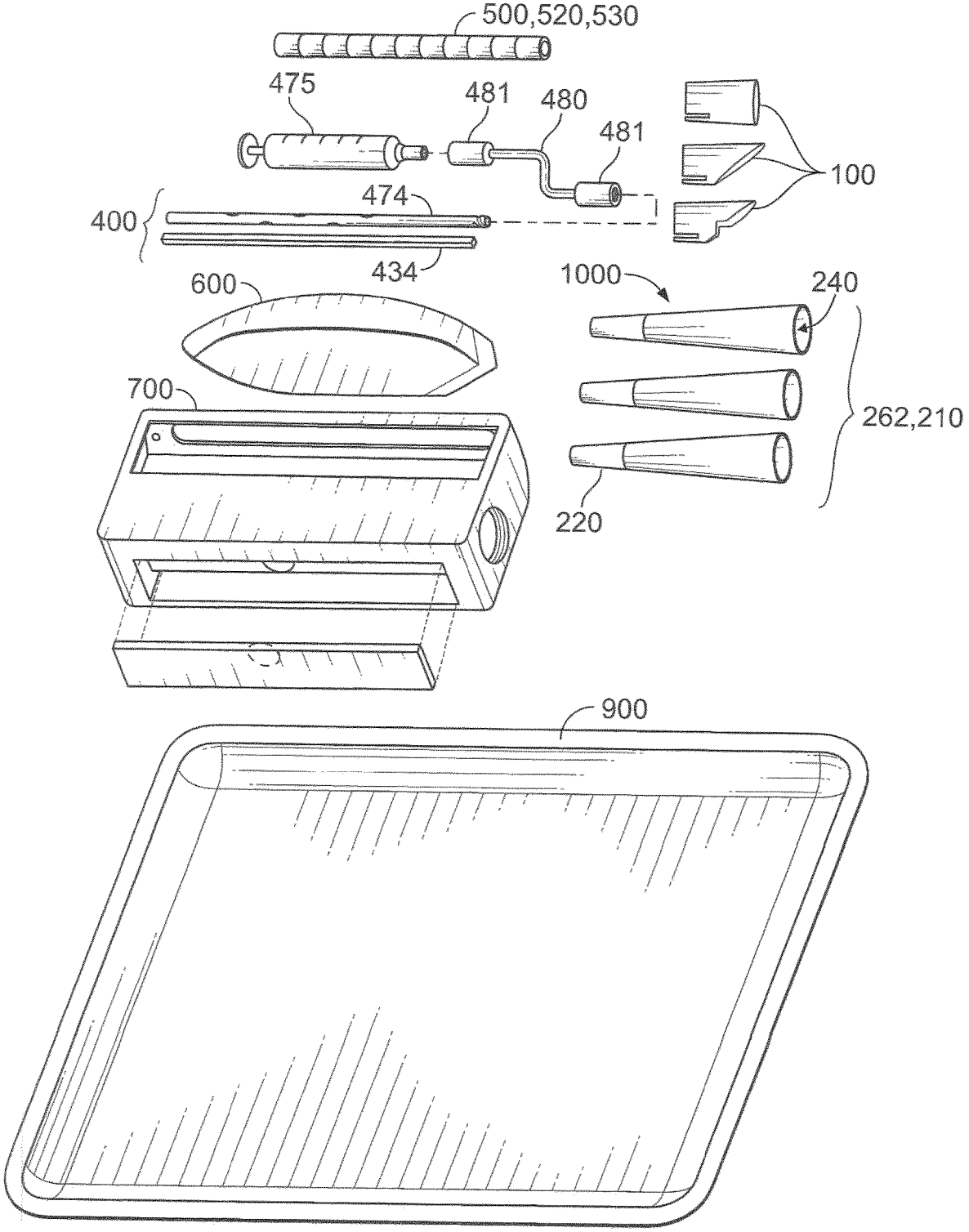
FIG. 2 is a top perspective exploded view of an embodiment of all the different parts for a single-user fluid chamber system material management transfer/storage system included in the material management transfer/storage on a tray, on which they could be placed at the time of assembly.

FIG. 2 is a top perspective exploded view of an embodiment of the fluid chamber mold system with material management transfer/storage 700 showing all different parts included the material management transfer/storage 700 on a tray 900 which can be used as a stable surface to assemble all the parts and form the fluid chamber mold system for a simple use. The parts of the material management transfer/storage include the compression tool 500, which can either be a cylindrical compression tool 520, or a magnetic compression tool 530, or an automated compression tool 540; different variations of suspension collars 100; a syringe 475; fluid mold tubing 480, fluid mold connector 481, fluid chamber molds 400, which could either be an internal bore with infusion holes 474, or a star or square shaped fluid chamber 434; a material management tool/scraper 600; material management transfer/storage 700, smoking vessel 210 which could be a conical smoking paper 262, with an open end 240, and a filter tip 220; and a tray 900.

Figure 3A:
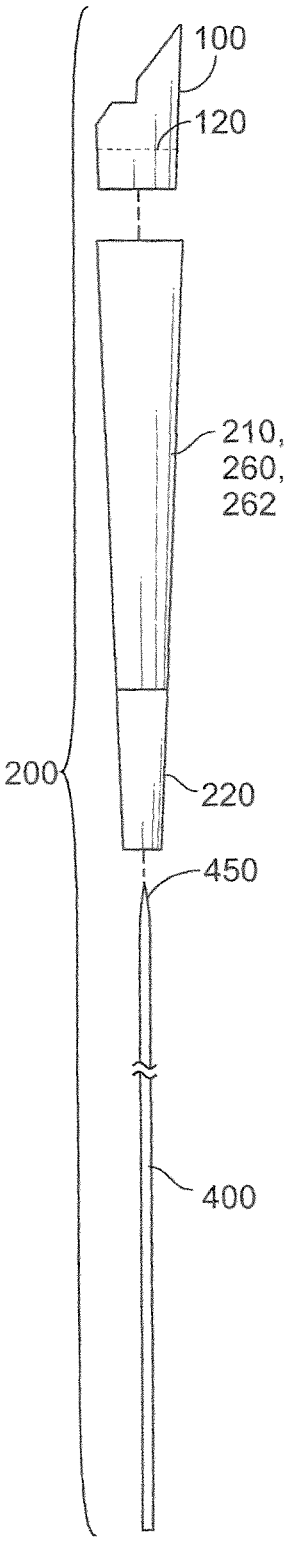
FIG. 3A is an exploded view of an embodiment of the fluid chamber mold system showing the manner in which the suspension collar and the fluid chamber mold fit into the top and bottom of the smoking vessel, which is a smoking paper, specifically a conical smoking paper.

FIG. 3A is an exploded view of an embodiment of the fluid chamber mold system 200 showing the manner in which the suspension collar 100 fits into the open end 240 of the smoking paper 260, specifically a conical smoking paper 262, with a fill line 120, while the fluid chamber mold 400 with a pointed end 450 fits into the filter tip of the smoking vessel, through the filter tip 220.

Figure 3B:
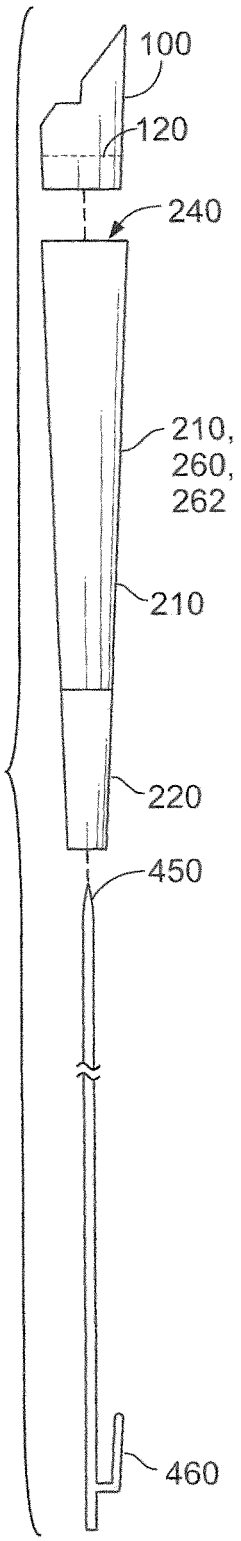
FIG. 3B is an exploded view of an embodiment of the fluid chamber mold system showing the suspension collar and fluid chamber mold with a fluid mold stabilizer about to be fitted into the top and bottom of the smoking vessel, respectively.

FIG. 3B is an exploded view of an embodiment of the fluid chamber mold system showing the suspension collar 100 and fluid chamber mold 400 with a fluid mold stabilizer 460 to be fitted into the open end and filter tip of the smoking vessel 210, respectively.

Figure 4:
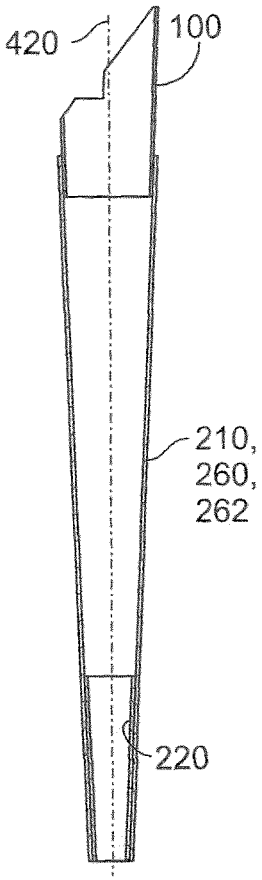
FIG. 4 is a front perspective view of an embodiment of the smoking vessel, which is a smoking paper, specifically a conical smoking paper, where suspension collar is inserted into the smoking vessel from the opening on its top, and the filter tip at the bottom.

FIG. 4 is a front perspective view of an embodiment of the smoking vessel 210, which is a smoking paper 260, specifically a conical smoking paper 262, showing the suspension collar 100 which is inserted into the smoking vessel 210 from the open end, and the filter tip 220, which is closed.

Figure 5:
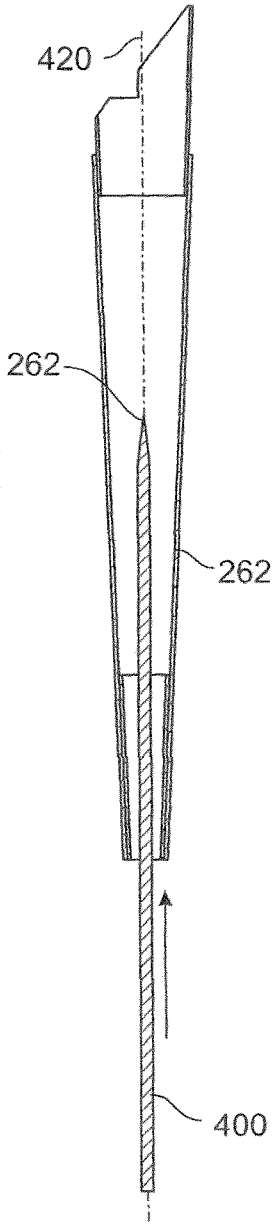
FIG. 5 is a front perspective view of the cross section of an embodiment of the fluid chamber mold system, where it is being assembled using the smoking vessel is a conical smoking paper, containing the suspension collar already inserted from the open end and the fluid chamber mold being inserted into smoking vessel, from the filter tip through the open end of the suspension collar, via the centerline of the smoking vessel. Even though this figure shows the fluid chamber mold being inserted into the smoking vessel from the filter tip, this fluid chamber mold may also be inserted through the open end.

FIG. 5 is a front perspective view of the cross section of an embodiment of the fluid chamber mold system 200, showing the steps involved in assembly of the said system, starting with a smoking vessel, which is conical smoking paper 262 containing a suspension collar as it has already been inserted into the open end. This is followed by the insertion of the fluid chamber mold 400 from the filter tip through the anterior opening of the suspension collar, along the centerline of the smoking vessel 420. Even though this figure shows the fluid chamber mold being inserted into the smoking vessel from the filter tip, this fluid chamber mold may also be inserted through the open end.

Figure 6A:
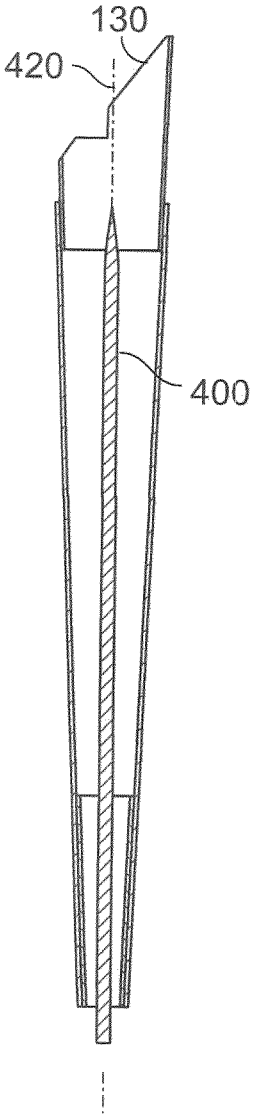
FIG. 6A is a front perspective view of the cross section of an embodiment of the fluid chamber mold system showing the smoking vessel containing both the suspension collar and the fluid chamber mold, which was inserted via the centerline of the smoking vessel.

FIG. 6A is a front perspective view of the cross section of an embodiment of the fluid chamber mold system showing the smoking vessel containing both the suspension collar and the fluid chamber mold, which was inserted along the centerline of the smoking vessel 420.

Figure 6B:
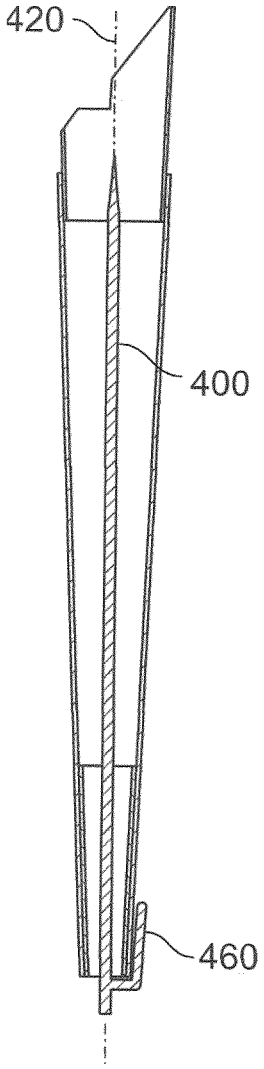
FIG. 6B is a front perspective view of the cross section of an embodiment of the fluid chamber mold system showing the smoking vessel with both the suspension collar and the fluid chamber mold with a fluid mold stabilizer.

FIG. 6B is a front perspective view of the cross section of an embodiment of the fluid chamber mold system showing the smoking vessel with both the suspension collar and the fluid chamber mold with a fluid mold stabilizer 460 which is used to hold the fluid chamber mold in place, making it easy for the user to scoop the smokable materials without the worry of the fluid chamber mold system opening and dispersing its contents everywhere.

Figure 7:
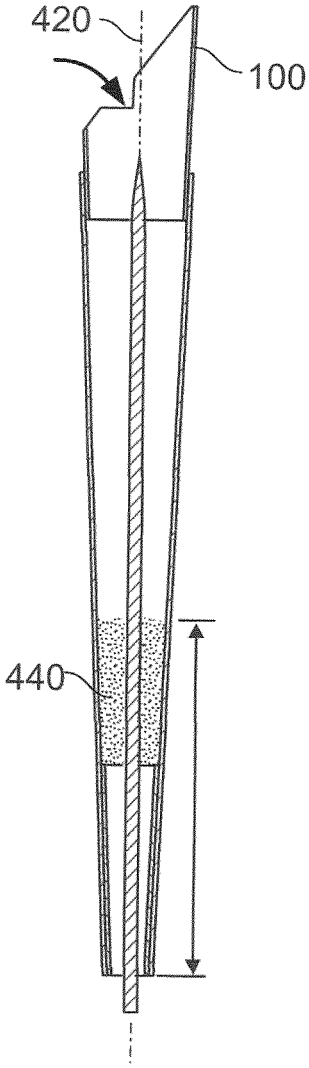
FIG. 7 is an illustration showing the cross section of an embodiment of the fluid chamber mold system where the smoking vessel is filled ⅓rd with smokable material by using the scoop in the suspension collar and the fluid chamber mold, which is inserted through the centerline of the smoking vessel.

FIG. 7 is an illustration showing the cross section of an embodiment of the fluid chamber mold system where the smoking vessel is filled ⅓rd (one-third) of the way with smokable material 440 by using the scoop 130 in the suspension collar 100, and the fluid chamber mold 400 is inserted through the centerline of the smoking vessel 420.

Figure 8:
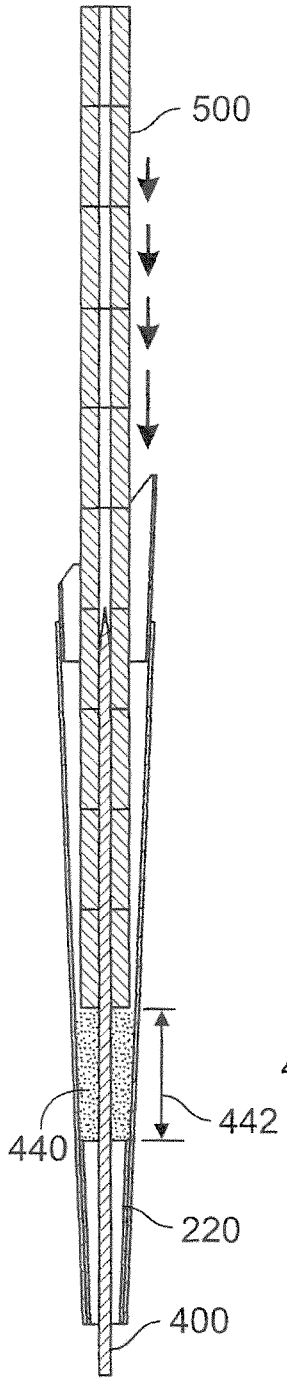
FIG. 8 is a front perspective view of the cross section of an embodiment of the fluid chamber mold system showing the smoking vessel filled similarly to the smoking vessel in FIG. 7, but in this embodiment, the smokable material is being packed by a compression tool.

FIG. 8 is a front perspective view of the cross section of an embodiment of the fluid chamber mold system showing the smoking vessel filled ⅓rd of the way with smokable material with the help of the scoop in the suspension collar and the fluid chamber mold, like in FIG. 7. In this embodiment, the smokable material is being compressed by gently pushing the compression tool 500 in a downward motion, so that the smokable material fills the smoking vessel, without any gaps.

Figure 9:
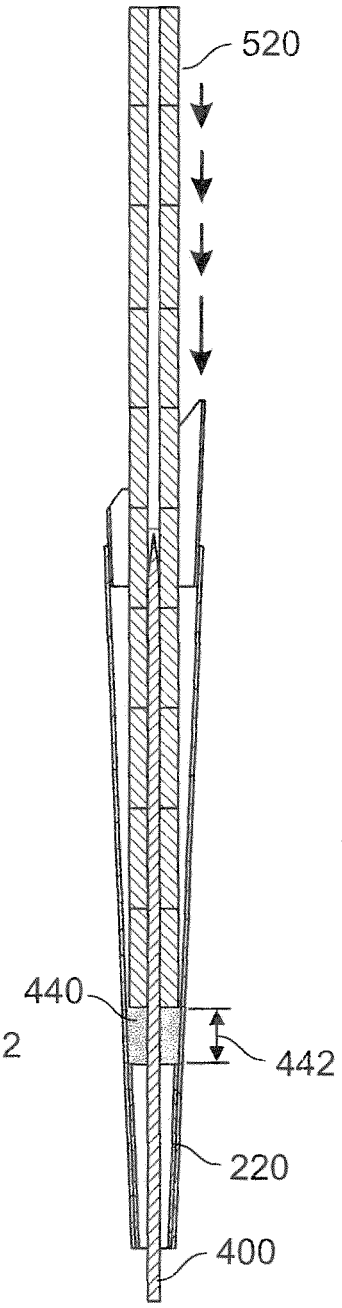
FIG. 9 is a front perspective view of the cross section of an embodiment of the fluid chamber mold system showing the smoking vessel filled and packed approximately ⅓rd with smokable material including the suspension collar, the scoop in the suspension collar, and the fluid chamber mold. In this embodiment, the smokable material was packed by gently pressing it, in a downward motion, with the compression tool, specifically a cylindrical compression tool, so that the compressed smokable material is packed without any voids, all the way from the smoking vessel's filter tip to the fill line.

FIG. 9 is a front perspective view of the cross section of an embodiment of the fluid chamber mold system showing the smoking vessel filled approximately ⅓rd of the way with smokable material with the help of the suspension collar, the scoop in the suspension collar, and the fluid chamber mold. In this embodiment, the smokable material was compressed by gently pressing it, with the compression tool, specifically a cylindrical compression tool 520, so that the compressed smokable material 442 is packed without any voids.

Figure 10:
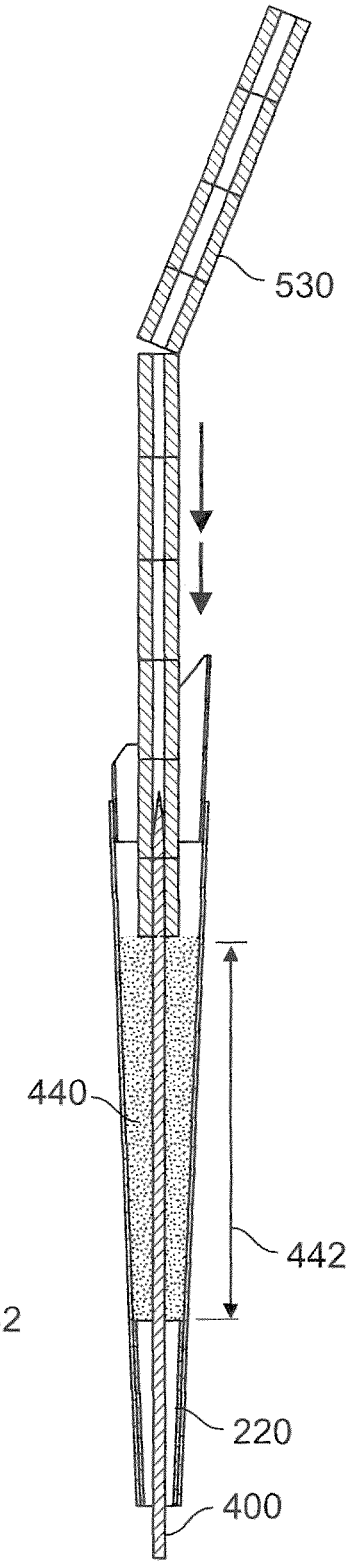
FIG. 10 is a front perspective view of the cross section of an embodiment of the fluid chamber mold system showing the break-away magnetic compression tool being used to pack the smokable material in the smoking vessel, to have compressed smokable material. When the maximum compression is reached, the break-away magnetic compression tool begins to break away.
Figure 11A:
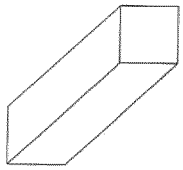
FIG. 11A, 11B, 11C, 11D shows the variations of shapes of the fluid chamber in the fluid chamber mold.
Figure 11B:
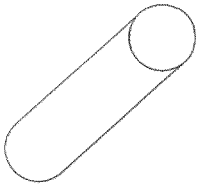
Figure 11C:
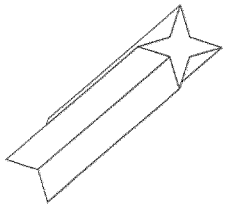
Figure 11D:
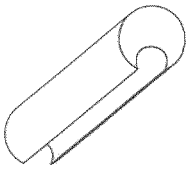

FIG. 10 is a front perspective view of the cross section of an embodiment of the fluid chamber mold system showing the break-away magnetic compression tool 530 being used to pack the smokable material 440 in the smoking vessel, to have compressed smokable material 442, which elevates the user's smoking experience. When using this magnetic compression tool, the magnets start to break away at the points where the poles are joined when the smoking vessel attains the right amount of pack without rupturing the smoking vessel for an enhanced user experience.

FIGS. 11A, 11B, 11C, 11D are a front perspective view of an embodiment of the fluid chamber mold system, where the fluid chamber mold 400, along the centerline of the smoking vessel is shaped like a star or a square 434, channeled shape 432, is round, or indented with a channel to allow for the passage of the infusion materials, if the user chooses to infuse the smoking vessel with organic plant-based concentrates.

Figure 12:
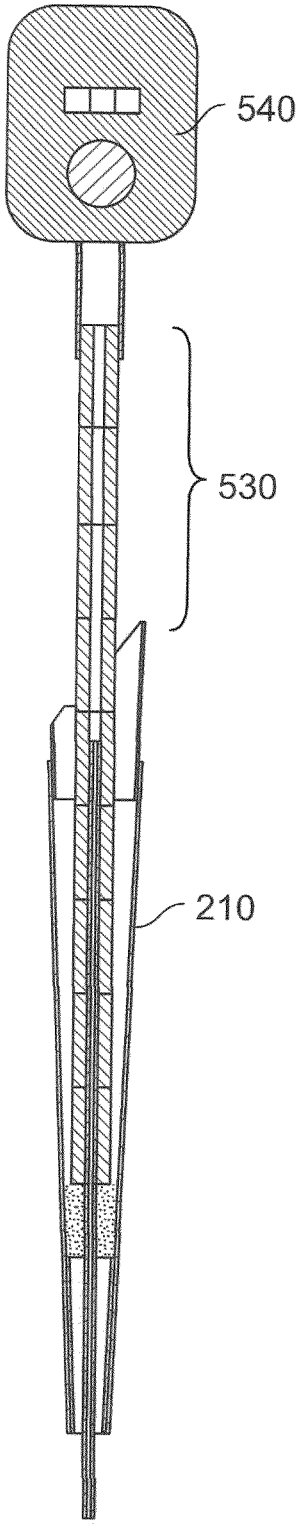
FIG. 12 is a cross section of an embodiment of the fluid chamber mold system showing the automated compression tool, which is also a magnetic compression tool compressing the smokable material in the smoking vessel to form compressed smokable material.

FIG. 12 is a cross section of an embodiment of the fluid chamber mold system showing the automated compression tool 540, which is also a magnetic compression tool 530, optimally compressing the smokable material in the smoking vessel to form compressed smokable material.

Figure 13:
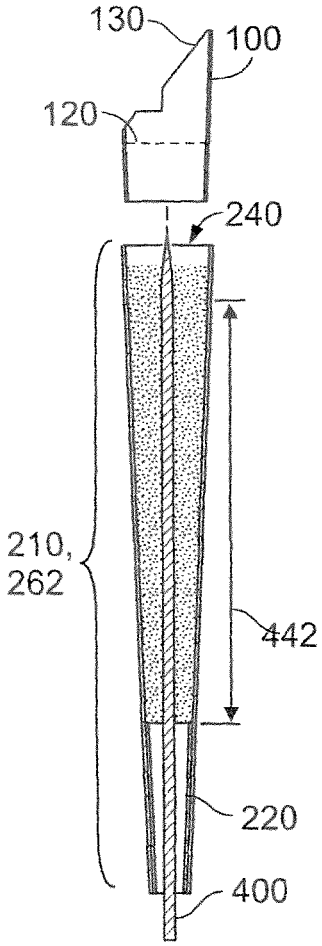
FIG. 13 is a front perspective cross sectional view of an embodiment of the fluid chamber mold system, showing the suspension collar, with the scoop and the fill, line being removed from the open end of the smoking vessel, specifically the conical smoking paper which is filled with compressed smokable material. It also shows the fluid chamber mold about to be removed from the bottom of the smoking vessel, via its filter tip. The fluid chamber mold may also be removed from the open end of the smoking vessel.

FIG. 13 is a front perspective cross sectional view of an embodiment of the fluid chamber mold system, showing a smoking vessel, specifically the conical smoking paper 262 already filled with smoking material 440, specifically, compressed smoking material 442, until the fill line 120, through the scoop 130 in the suspension collar 100 and the open end 240 of the conical smoking paper 262, to the conical smoking paper's filter tip 220. In this embodiment, the fluid chamber mold 400 is about to be removed from the conical smoking paper's 262 filter tip 220. The fluid chamber mold may also be removed from the open end of the smoking vessel. FIG. 13 does not show removal of the fluid chamber mold from the open end of the smoking vessel.

Figure 14:
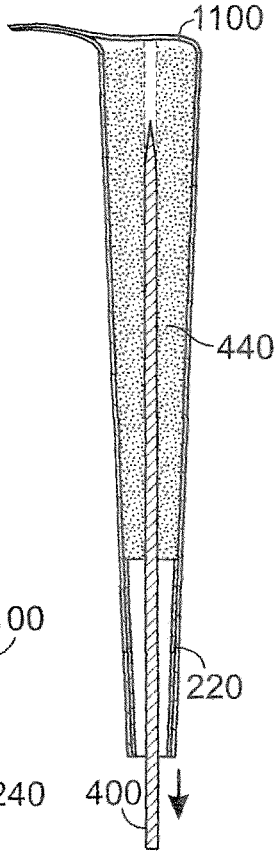
FIG. 14 is a front perspective cross sectional view of an embodiment of the fluid chamber mold system showing the top of the filled and compressed smoking vessel is folded over the top and kneaded downwards as the remaining smoking paper on the top of the smoking vessel is tightly twisted to seal the top while the fluid chamber mold is being removed from the bottom of the smoking vessel to leave a fluid chamber. This fluid chamber mold may also be removed from the top of the smoking vessel, via the open end to leave a fluid chamber. This figure does not show the removal of the fluid chamber mold from the open end of the smoking vessel. If the fluid chamber mold is removed from the top, steps shown in FIG. 16 may be followed to properly seal the smoking vessel.

FIG. 14 is a front perspective cross sectional view of an embodiment of the fluid chamber mold system showing the process of sealing the hand rolled smoking device 1100 from the top. At this stage, the smoking vessel is already filled and packed with smokable material 440 and the suspension collar 100 has been removed from the open end of the smoking vessel. To begin sealing the filled and packed smoking vessel, the smoking paper on the open end is folded over and kneaded downwards as the remaining smoking paper on the top of the smoking vessel is tightly twisted. Any further excess paper can be carefully torn off at this point. Next, the fluid chamber mold should 400 removed from the bottom of the smoking vessel to achieve the desired fluid chamber of the smoking vessel. This fluid chamber mold may also be removed from the top of the smoking vessel, via the open end to leave a fluid chamber. This figure does not show the removal of the fluid chamber mold from the open end of the smoking vessel. If the fluid chamber mold is removed from the top, steps shown in FIG. 16 may be followed to properly seal the smoking vessel.

Figure 15:
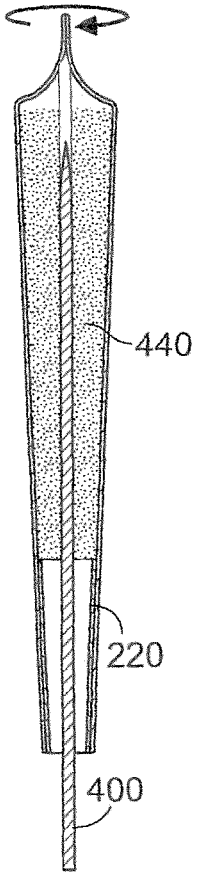
FIG. 15 is a cross sectional illustration of an embodiment of the fluid chamber mold system showing the twisted top of the filled and compressed smoking vessel while the bottom of the fluid chamber mold is completely removed from the bottom of the smoking vessel, exposing the fluid chamber which is the void created when the fluid chamber mold removed from the centerline of the smoking vessel. Here, the fluid chamber mold might also be completely removed from the top of the smoking vessel to expose the fluid chamber.

FIG. 15 is a cross sectional illustration of an embodiment of the fluid chamber mold system showing the fluid chamber mold 400 being removed from the open end of the smoking vessel filled and packed with smokable material 440, exposing the fluid chamber 430 which is the void created along the centerline of the smoking vessel, when the fluid chamber mold is removed. Here, the top of the smoking vessel has been twisted and sealed to avoid any spillage of smokable materials, prior to the removal of the fluid chamber mold 400. Here, the fluid chamber mold might also be completely removed from the top of the smoking vessel to expose the fluid chamber. FIG. 15 does not show removal of the fluid chamber mold from the open end/top of the smoking vessel.

Figure 16:
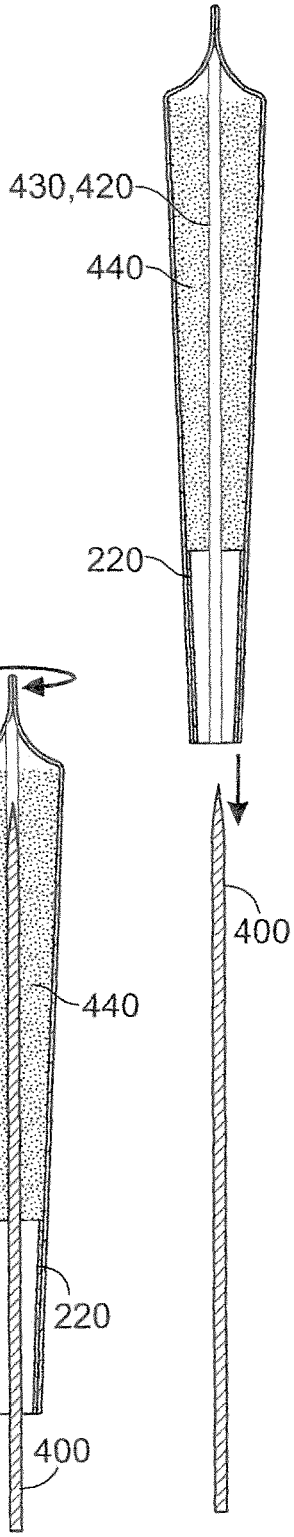
FIG. 16 is a cross sectional illustration of an embodiment of the smoking device showing the kneaded and twisted open end of the filled and compressed smoking vessel, where the excess smoking paper is hand trimmed to effectively compact and seal the smoking device at both its formerly open end and its enclosed filter tip.

FIG. 16 is a cross sectional illustration of an embodiment of the smoking device showing the packed, twisted, and sealed end of the filled and compressed smoking vessel, where the excess smoking paper is hand trimmed to effectively compact and seal the smoking device at both its formerly open end and its enclosed filter tip. Here, the fluid chamber 430 which can also be used as an infusion transfer 470 which could also hold an internal bore with infusion holes 472.

Figure 17:
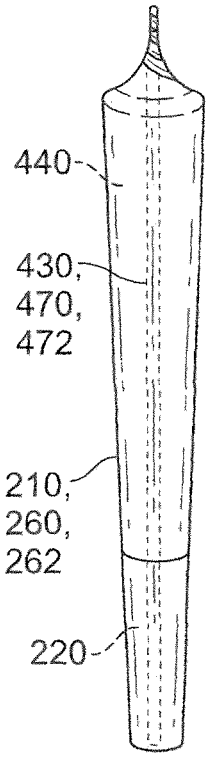
FIG. 17 is a front perspective of an embodiment of the smoking device showing the sealed smoking vessel with a void fluid chamber, which is channel shaped, and the compressed smokable material filled from the filter tip.

FIG. 17 is a front perspective of an embodiment of the smoking device showing the outside of a sealed smoking vessel with a filter tip 220, a fluid chamber 430, which could be used during infusion transfer 470 and could hold an internal bore with infusion holes 472.

Figure 18:
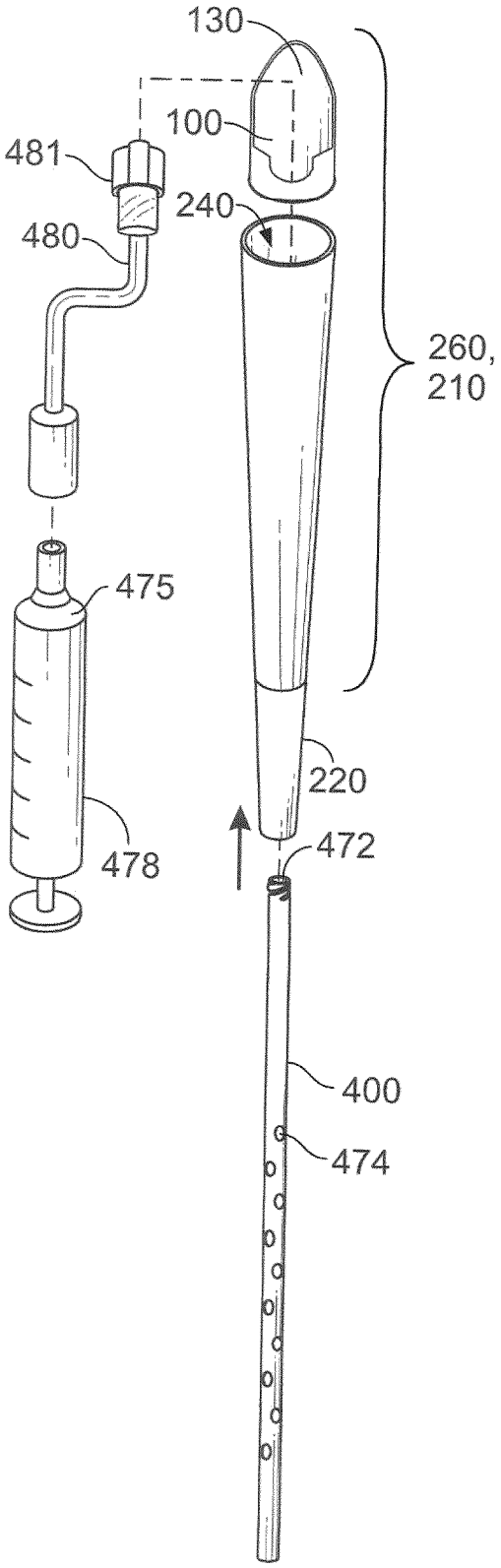
FIG. 18 is a front perspective illustration of how the manual infusion transfer embodiment of the fluid mold pump, containing a syringe, which is an infusion tank which connects to the clear or semi-transparent fluid mold tubing by a fluid mold connector, which is further connected to the fluid chamber mold internal bore with another fluid mold connector, inside the smoking vessel, which is a smoking paper. The internal bore has different sized holes for even infusion.

FIG. 18 is a front perspective illustration of the infusion transfer 470 embodiment of the fluid chamber mold system, containing a syringe 475, which acts as an infusion tank 478 with infusion material, a fluid mold connector 481, with fluid mold tubing 480, a smoking vessel 210, specifically a smoking paper 260, and the fluid chamber mold 400, which acts as an infusion channel 472, with an interior bore with infusion holes 474. Here, the syringe 475 acting as an infusion tank 478 on one side of the smoking vessel 210, specifically a smoking paper 260, is about to be connected to the fluid chamber mold 400, which acts as an infusion channel 472, with an interior bore with infusion holes 474, on the other side of the said smoking vessel, by a fluid mold connector 481, with a fluid mold tubing 480, for infusion transfer 470.

Figure 19:
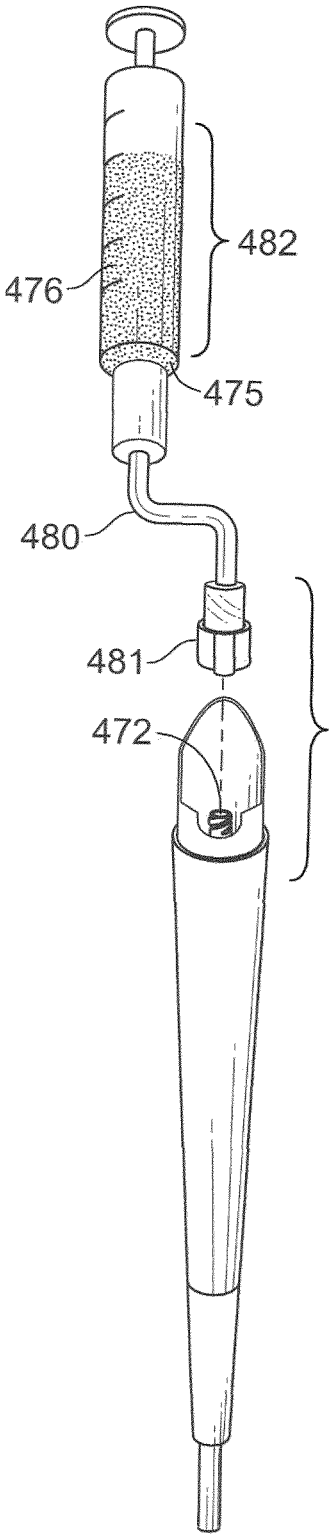
FIG. 19 is a front perspective view of the fluid chamber mold system, showing infusion transfer means with the fluid mold pump, which is a syringe containing the infusion tank filled with infusion material connected to the clear or semi-transparent fluid mold tubing and is to be connected with a fluid connector to the fluid chamber mold placed in the smoking vessel.

FIG. 19 is an front perspective view of the fluid chamber mold system, showing infusion transfer mechanism 470 where the fluid mold pump 482, which is the syringe 475 containing the infusion tank filled with infusion material 476 is connected to one end of the clear or tinted fluid mold connector 481 with fluid mold tubing 480 and is about to be connected to the infusion channel 472 in the smoking vessel, so that the infusion material 476 flows into the infusion channel 472 and infuses the smokable material within the smoking vessel.

Figure 20:
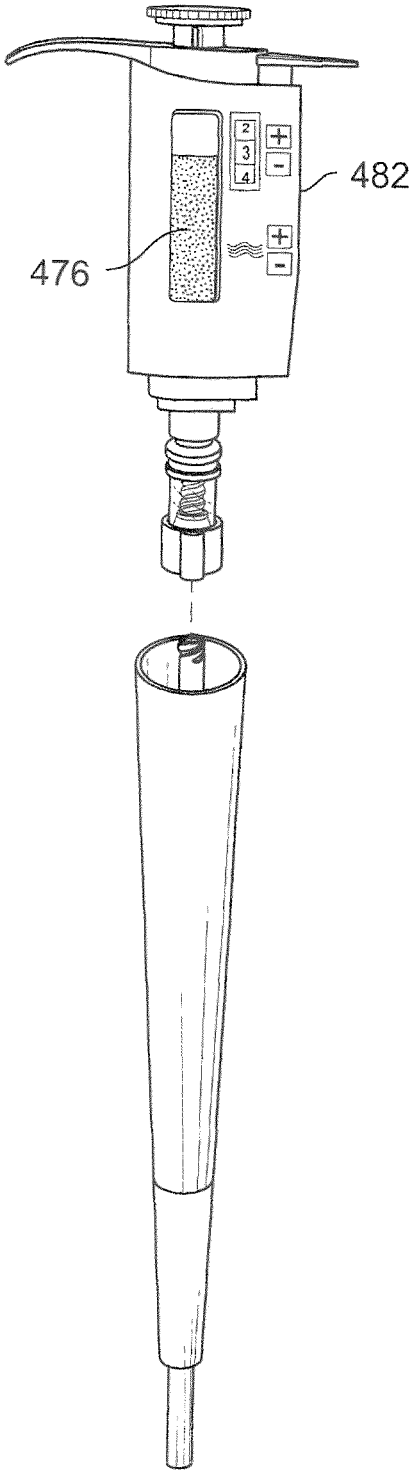
FIG. 20 is a from perspective view of the fluid chamber mold system, showing the fluid mold pump containing the infusion material in an infusion tank and is about to be connected to the smoking vessel.

FIG. 20 is a front perspective view of the fluid chamber mold system, showing the fluid mold pump 482 containing the infusion material 476 and is about to be connected to the infusion channel in the smoking vessel. When the fluid mold pump 482 is engaged, it will release the infusion material 476 into the infusion channel surrounding the smokable material, in the smoking vessel, thereby infusing the smokable material.

Figure 21:
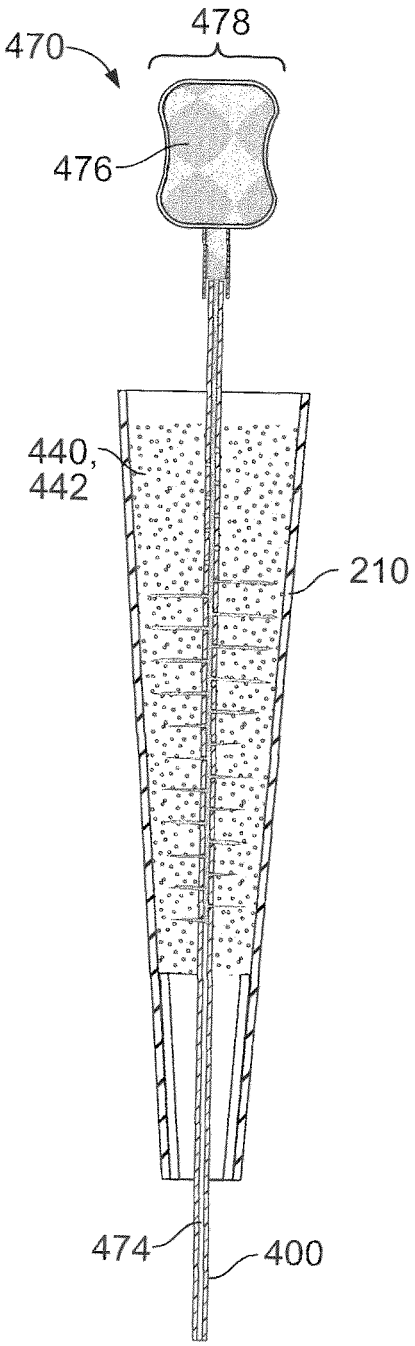
FIG. 21 is a cross section of an illustration showing the infusion transfer method, where the smokable material/compressed smokable material in the smoking vessel is infused with the infusion material contained in an infusion tank. The infusion material passes through the infusion channel with an internal bore containing infusion holes.

FIG. 21 is a cross section of an illustration showing the infusion transfer 470 where the smokable material/compressed smokable material 440/442 in the smoking vessel 210 is being infused with the infusion material 476 from an infusion tank 478. The infusion material 476 passes through the infusion channel with an internal bore containing infusion holes 474, in the fluid chamber mold 400, to infuse the smokable material/compressed smokable material 440/442.

Figure 22:
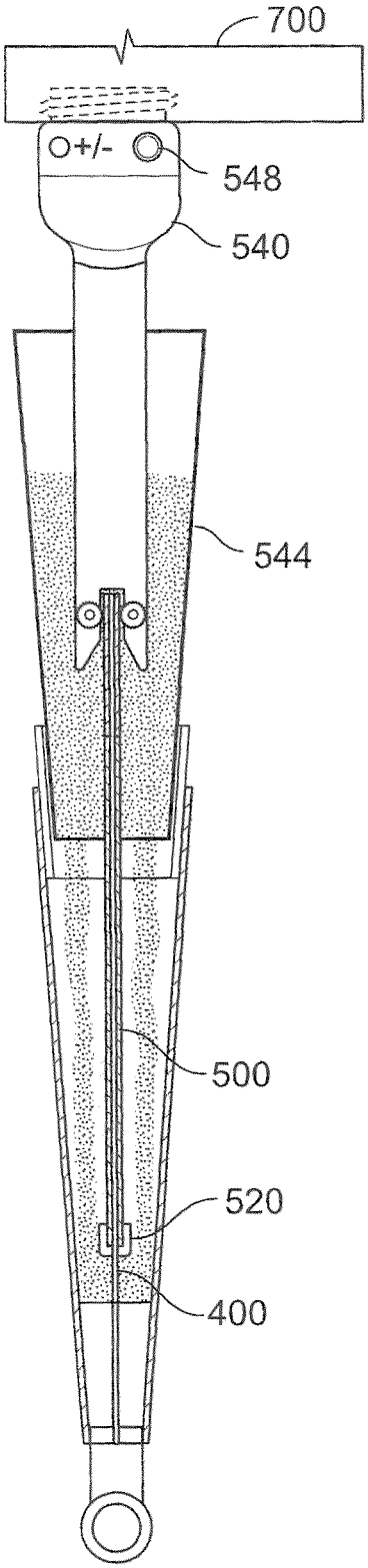
FIG. 22 is a cross section of an embodiment of the fluid chamber mold system showing an automated compression tool with a storage hopper containing smokable material, being used to fill the smoking vessel via the fluid chamber containing silicone end caps. It also shows the top of the automated compression tool fitting into the material management transfer/storage to provide further smokable material for packing.

FIG. 22 is a cross section of an embodiment of the fluid chamber mold system showing an automated compression tool 540 with an on/off button/sensor light/alarm/light indicator 548, and a storage hopper 544 containing smokable material, being used to fill the smoking vessel around the fluid chamber mold 400. Here, the compression tool 500 with silicone end caps 520 is packing the smokable material in the smoking vessel. The automated compression tool 540 fits into the material management transfer/storage 700.

Figure 23:
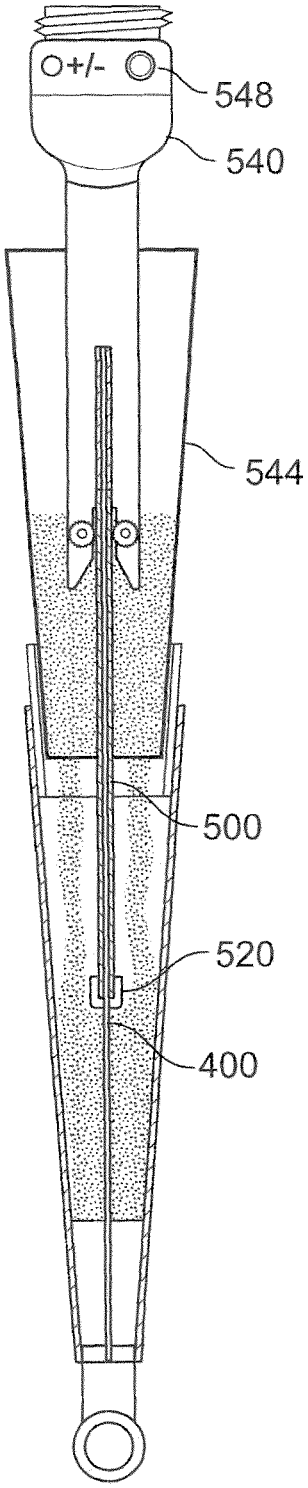
FIG. 23 is a cross section of an embodiment of the fluid chamber mold system, showing an automated compression tool with a twist lock transfer connection, and an on/off button/sensor light/alarm/light indicator being used to fill and pack the smoking vessel with the smokable material. The fluid chamber around the fluid chamber mold can also be seen. In this drawing, the smoking vessel is half filled and packed with the smokable material.

FIG. 23 is a cross section of an embodiment of the fluid chamber mold system showing an automated compression tool 540 with an on/off button/sensor light/alarm/light indicator 548, and a storage hopper 544 containing smokable material, being used to fill the smoking vessel around the fluid chamber mold 400. Here, the compression tool 500 with silicone end caps 520 is packing the smokable material in the smoking vessel. In this drawing, the smoking vessel is half filled and packed with the smokable material.

Figure 24:
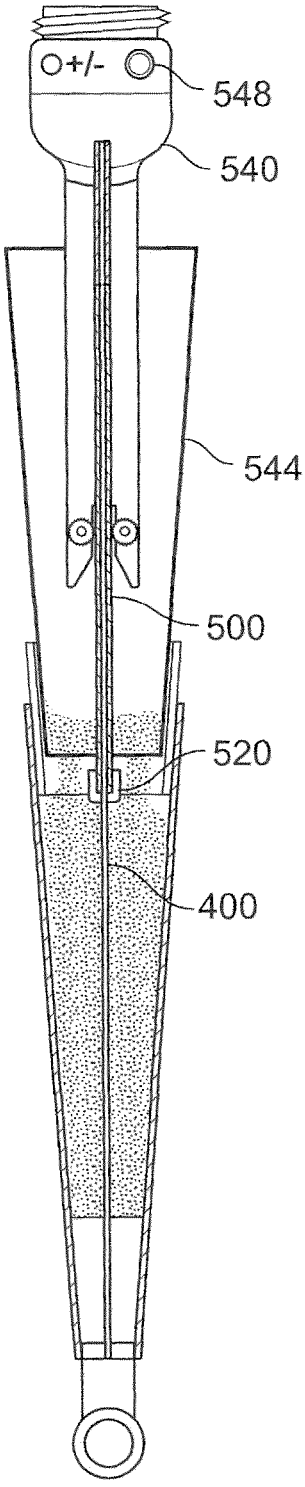
FIG. 24 is a cross section of an embodiment of the fluid chamber mold system with an automated compression tool where it is used to fill and pack the smoking vessel. In this drawing, the smoking vessel is almost all the way filled with compressed smokable material.

FIG. 24 is a cross section of an embodiment of the fluid chamber mold system showing an automated compression tool 540 with an on/off button/sensor light/alarm/light indicator 548, and a storage hopper 544 containing smokable material, being used to fill the smoking vessel around the fluid chamber mold 400. Here, the compression tool 500 with silicone end caps 520 is packing the smokable material in the smoking vessel. In this drawing, the smoking vessel is almost all the way filled with compressed smokable material.

Figure 25:
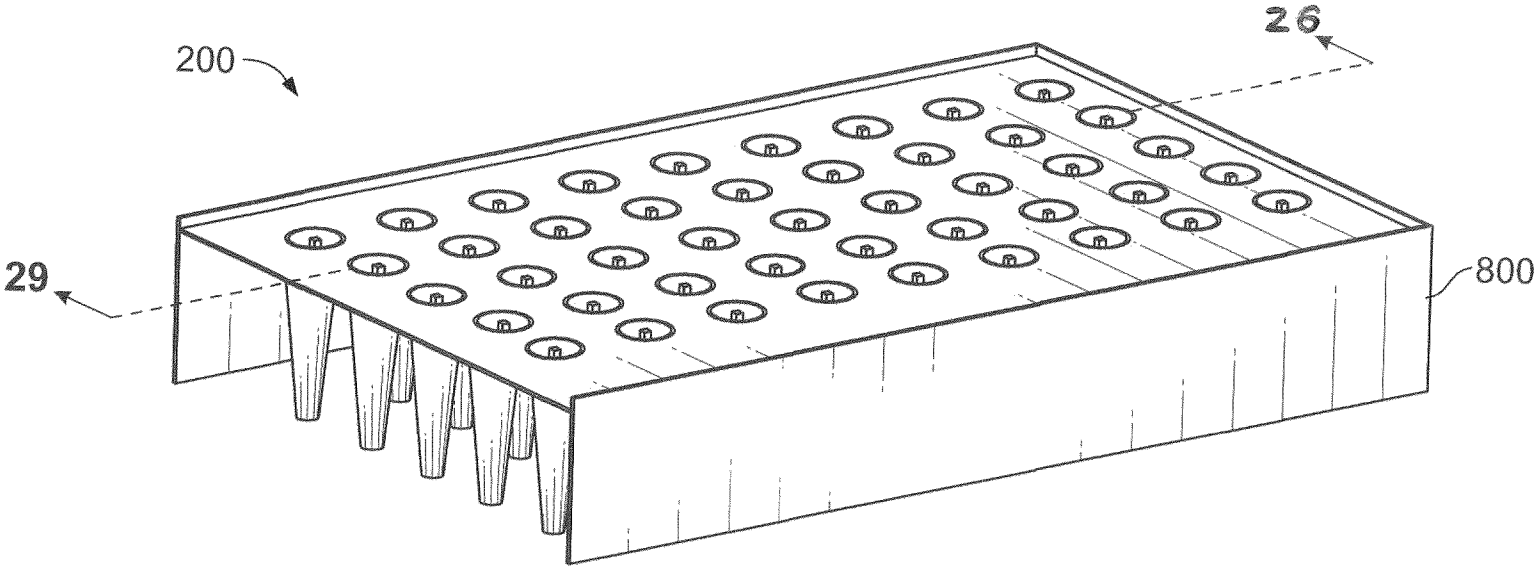
FIG. 25 is a one side perspective view of an embodiment of the fluid chamber mold system showing the automated/mass manufacturing/multi-fill which is used to automate filling multiple smoking papers with smokable materials. It also shows a dashed line indicating the cross section of FIG. 26.

FIG. 25 is a one side perspective view of an embodiment of the fluid chamber mold system showing the automated/mass manufacturing/multi-fill 800 used to automate filling multiple smoking papers with smokable materials. In this process, the smokable vessels are lined up in a manner in which the filter tips point downward, whereas the open ends point upward. These open ends are ready to be filled with the smokable materials. It also shows a dashed line indicating the cross section of FIG. 26.

Figure 26:
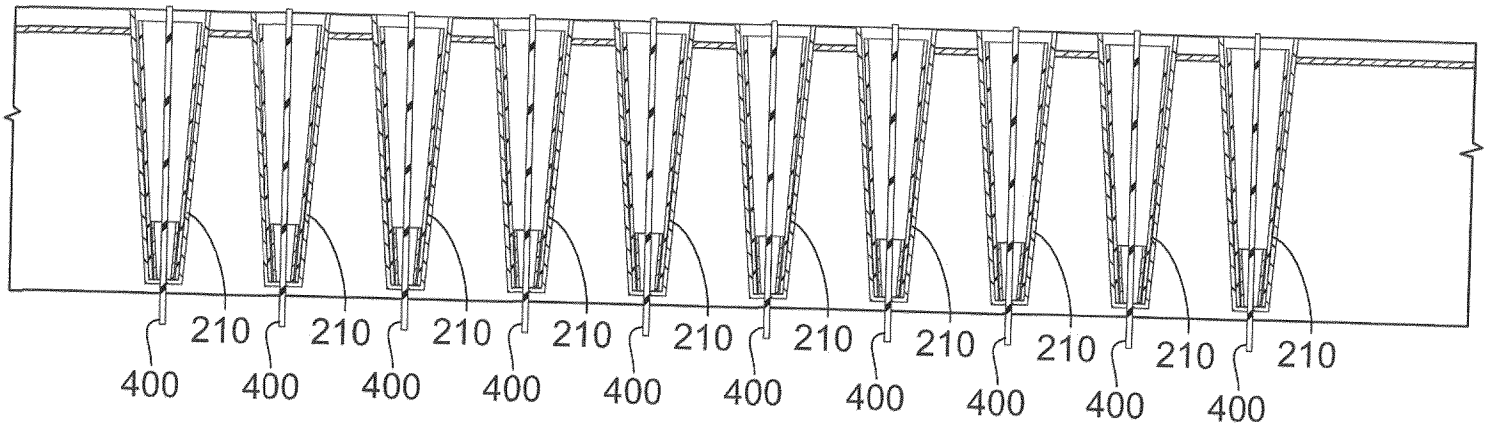
FIG. 26 is a cross section of an embodiment of the fluid chamber mold system, showing the automated/mass manufacturing/multi-fill, showing multiple smoking papers with a fluid chamber mold, that are connected to each other and are ready to be filled with smoking material.

FIG. 26 is a cross section of an embodiment of the fluid chamber mold system, showing the bottoms of the automated/mass manufacturing/multi-fill, where multiple smoking vessels 210 with fluid chamber molds 400, are lined up and are ready to be filled with smokable materials.

Figure 27:
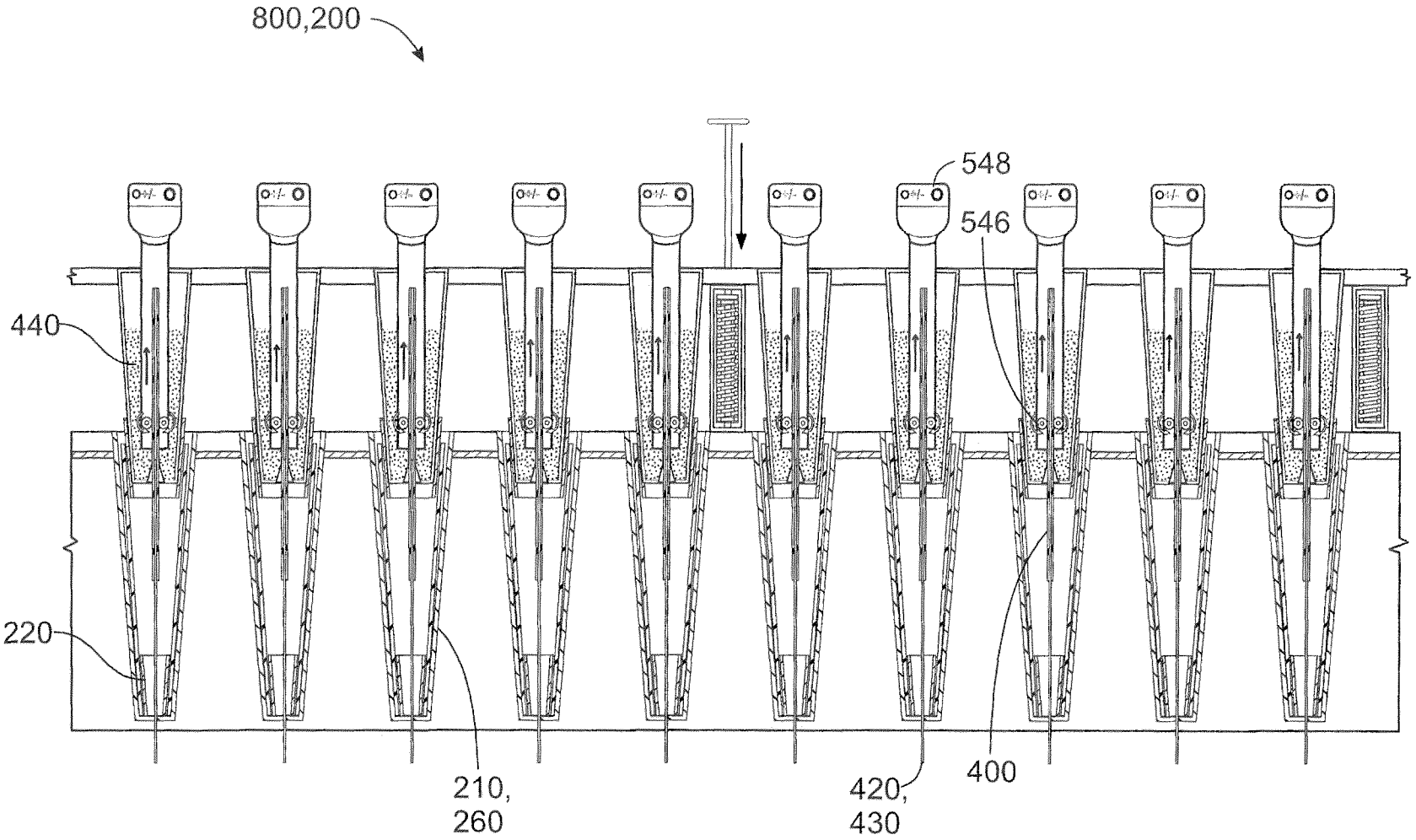
FIG. 27 is a cross section illustration an embodiment of the fluid chamber mold system, showing automated/mass manufacturing/multi-fill, showing a series of automated compression tools with on/off button/sensor light/alarm/light indicator, programmable pressure sensors being used to fill and compress multiple smoking vessels, which are smoking papers with filter tips with smokable materials. These smoking vessels have filter tips and fluid chamber mold with fluid chamber running through the center line of the smoking vessel.
Figure 28:
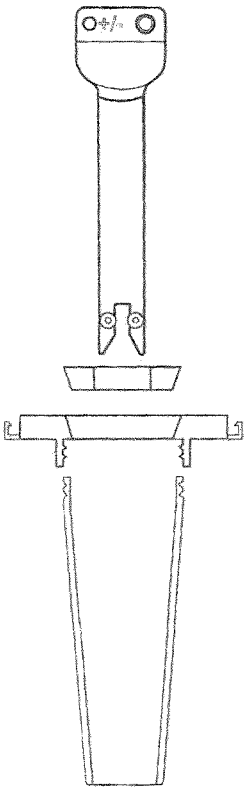
FIGS. 28-32 are similar to FIGS. 22, 23, and 24, and shows how an automated single fluid chamber mold system can be scaled up by joining with other single fluid chamber mold systems to form a manufacturing system that is larger than the single fluid chamber mold system and smaller than the automated/mass manufacturing/multi-full system.
Figure 29:
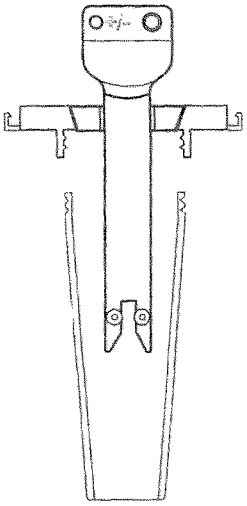
Figure 30:
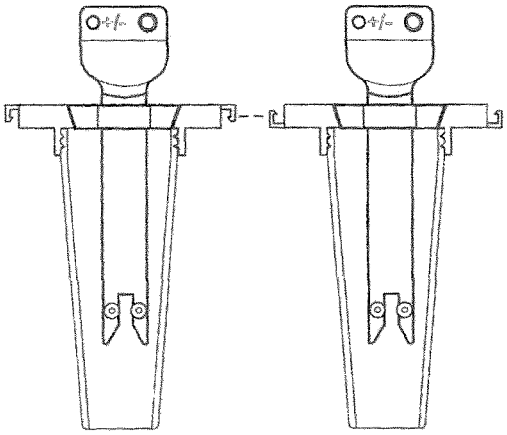
Figure 31:
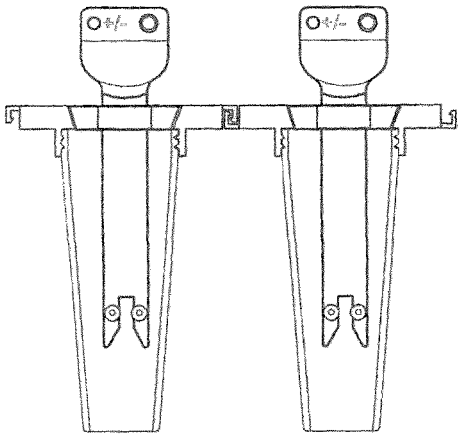
Figure 32:
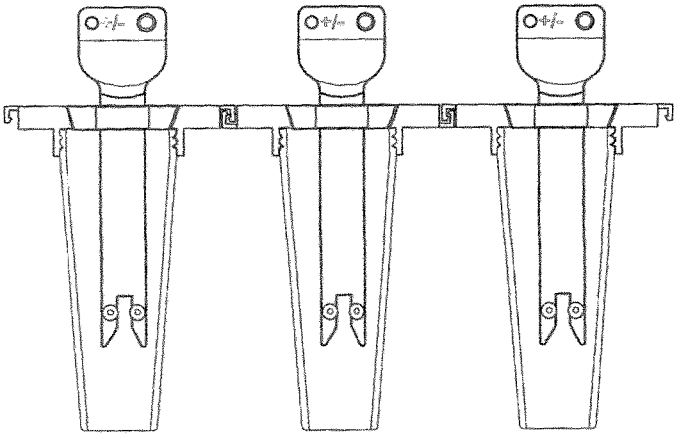

FIG. 27 is a cross sectional illustration of an embodiment of the fluid chamber mold system 200, showing automated/mass manufacturing/multi-fill 800, with a series of automated compression tools with on/off button/sensor light/alarm/light indicators 548, and programmable pressure sensors 546, being used to fill and compress multiple smoking vessels 210, which are smoking papers 260 with filter tips 220. These automated compression tools are filling the smoking papers 260 with smokable materials, around the fluid chambers 430, in the fluid chamber molds 400, along the centerline of the smoking vessels 420 have filter tips and fluid chamber mold with fluid chamber running through the center line of the smoking vessel.

FIGS. 28-32 are similar to FIGS. 22, 23, and 24, and it shows how a single fluid chamber mold system can be scaled up by joining with other single fluid chamber mold systems to form a manufacturing system that is larger than the single fluid chamber mold system and smaller than the automated/mass manufacturing/multi-full system.

Hand-rolled smoking device 1100 is a smoking device made with smokable papers. The smoking materials in a hand-rolled smoking device are either filled, packed, stuffed, compressed, or assembled with either the assistance of a filling/rolling devices, tools, forms, machines, gravity fed, presses or free-hand.

suspension collar 100 is a removable tool designed to provide shape and structure to smokable papers during the assembly process, like a filling cone. The suspension collar is round or oval in shape, depending on the intended smoking vessel. The material can either be any man-made or synthetic materials that meets the design and application tolerances. The suspension collar creates a foundation, where a clamping force is applied by the hand, anchors, clamps, elastics, suction, friction, locks, expansion, contraction, or any other viable means to secure the paper in place while filling the smoking device. The suspension collar in concert with a griping force applied to the inserted smoking paper creates an anchor where the "span" of the bridge is anchored between the open end and the filter tip.

fill line 120 is the line on the suspension collar marking the point up to which the smokable materials can ideally be filled in the smoking vessel.

scoop 130 is the area at the top of the suspension collar used to urge smoking materials into the smoking device.

fluid chamber mold system 200 is a system comprising a smoking vessel with a filter tip and an open end, a fluid chamber mold which can be placed in the centerline of the smoking vessel to create a fluid chamber, around which the smokable material can be packed in the smoking vessel.

smoking vessel 210 is the material that provides structure and contains the smokable material; constructed from any material which is either consumed during thermodynamic reactions or remain integral during the chemical reactions which occur during decarboxylation of smokable material. Material and construction of the vessel includes smokable papers, rolling papers, cones, glass, wood, metals, organic plant based, synthetic, engineered derived plant based, stone and any other material not yet conceived at the time of application. Smoking vessel materials include: smokable papers, rolling papers, cones, wraps, cigarillo wrappers, preformed or in sheet pipes, vapes, rolled/fresh leaves, tobacco leave, tree leaves, hemp, rice, cellulose, cotton, wood pulp, cardboard. Smoking vessels are available in a range of shapes and sizes which are known and common place to a person of ordinary skill in the art.

filter tip 220 is the tip of the smoking vessel made of: cotton, plant/tree fibers, fabric, cellulose, hemp, wool, foam, fiberglass, paper, cardboard, glass, steel, wood, silicone, or any suitable materials which meet the size and shape specifications to make with a pre-formed or hand-made smoking paper. A person of ordinary skill in the art would appreciate that filter tips are available in a range of sizes and materials, and may be constructed of glass, wood, paper, cotton, linen, and cardboard, synthetic fibers, blended materials, metal, stone, and engineered materials, man-made, or naturally occurring materials which are known and common place to a person of ordinary skill in the art.

open end 240 is the end of smoking vessel that is used to insert the suspension collar through which the smoking vessel can be filled with smokable materials. It is also the opposite end of the filter tip. The fluid chamber mold may be inserted or removed through this open end.

smoking paper 260 is one type of smoking vessel which facilitates the organization and structure to the smoking materials for human consumption into a smoking device. Smoking papers can be constructed from any material derived, part or whole, from a plant, tree, of organic and inorganic in origin, constructed with materials and glues deemed safe for human consumption. Smoking papers are available in a range of specifications, as a person of ordinary skill in the art would understand.

conical smoking paper 262 is a further delineation of a type of smoking paper that is conical in shape, preformed into a conical shape with a glued linear, spiral, patch-work, or horizontal seams. It is intended to provide organization and structure to the smoking materials for consumption. These are common and well-known to a person of ordinary skill in the art.

fluid chamber mold 400 is a removable tool which builds an engineered internal fluid chamber, centerline of the smoking device, which is a void in the compressed smoking materials, leaving a precision fluid chamber after the tool is removed. The fluid chamber mold, when appropriated with an internal bore, located centerline of the tool, is a channel which can be in the shape of a circle, square, four point star, five point star, or an oval, will transport the infusion of organic plant-based concentrate down the through outer edges or channels, or precision micro holes along the length of the tool to the compressed organic smokable materials. The size, shape, dimensions, and surface area specifications have been engineered to deliver different smoking experiences based on the variety of material and manufacturing limitations. Other prior art may have sticks, rods, toothpicks. But not a calibrated fluid mold to match the volume of the specified paper. No prior art has the fluid chamber, which is built/formed by compressing the material around an engineered fluid mold. In particular, the square or star shape embodiments create internal edges on the compressed smokable material that increase the structural stability of the fluid chamber after the fluid chamber mold is removed. The fluid mold may have a lock tip at the bottom to join/secure the fluid mold to filter tip section of the smoking paper.

centerline of the smoking vessel 420 is the middle, center, longitudinal axis of the smoking vessel.

fluid chamber 430 is a centerline void that is created when the fluid chamber mold is removed from the column of compressed organic smoking materials which were shaped around the fluid. The size, shape, and materials used in the manufacturing of the smoking vessel, fluid chamber mold, and the suspension collar affects the performance and thermodynamic efficiency and desired airflow of the overall smoking experience.

channeled shape 432 is a long, indented channel or edge, on the fluid chamber mold, with an area to let the infusing material flow through the length of the fluid chamber mold and be delivered uniformly to the compressed smokable material. It also creates internal structural edges for increased fluid chamber stability.

star or square shaped 434 is the shape of the fluid chamber mold from a lateral cross-section. The star shaped fluid chamber mold can either be a three, four, five, six, or more pointed star.

smokable material 440 is often organic in nature, in that, it derives from a carbon-based life form. This is common and well-known to a person of ordinary skill in the art. The material is assembled within a smoking vessel for consumption. Organic materials refer to materials which are intended for human consumption and are commercially available to consumers. The coarseness of smokable material is the required size of broken-down plant material to an acceptable size and shape tolerances for the intended smoking device vessel preferred methods. Smokable material coarseness can be approximated through mechanical separation using: hand separation, purpose-built hand grinders, electric grinders, spice and coffee grinders, blenders, or purpose built commercial grinders. Smokable material 440 is also being referred to as smoking material 440 in this application. Furthermore, the plural form of smokable materials 440 and smoking materials 440 is also used in this application to refer to this smoking material 440.

compressed smokable material 442 is the same smokable material as in 440, but which has been packed into the smoking vessel with the help of a compression tool.

pointed end (of the fluid chamber mold) 450 is the end of the fluid chamber mold that can be used when an embodiment of the invention involves inserting the fluid chamber mold through the filter tip of the smoking vessel. A pointed end makes it more efficient and usable.

fluid mold stabilizer (of the fluid chamber mold) 460 is a cuff or cap on the fluid chamber mold, opposite of the inserted end that helps hold and stabilize the fluid chamber mold to stay in the centerline while smoking material is being added.

infusion transfer 470 is an optional process and components to allow for infusion of the smokable material after packing into the smoking vessel, by way of adding oil or liquid concentrate through the fluid chamber mold.

infusion channel 472 is similar to and another aspect of the channeled shape of the fluid chamber mold.

internal bore with infusion holes 474 is a further limitation of the infusion channel where the channel is internal to the fluid chamber mold.

syringe 475 is a simple reciprocating pump with a piston that could hold infusion materials in its chamber and could be used to manually infuse the infusion materials into the compressed smokable materials.

infusion material 476 is an organic oil or liquid concentrate with specific viscosity that is suitable for transfer through the internal bore with infusion holes in the fluid chamber mold.

infusion tank 478 is a reservoir of infusion material which is transferred through the fluid mold tubing and fluid mold vis-a-vis fluid mold connector.

fluid mold tubing 480 consists of clear or tinted tubing that creates a flexible bridge between the infusion tank and the fluid chamber mold. This tubing is clear, flexible, food safe, and non-leaching. It may be linked, joined in series, or parallel to fill multiple smoking devices at a time. Connectors may join one or more tubes, fluid mold, and infusion tank.

fluid mold connector 481 is a cock-stop connection point for the infusion tank and the fluid chamber mold to join. A fluid mold connector is clear to visualize transfer of the infusion material. It connects to multiple infusion tanks, tubing ports, and fluid molds, if necessary.

fluid mold pump 482 is a general pump like mechanism which is used to facilitate movement of the infusion material from the infusion tank to the fluid mold. The fluid mold pump can be: hand operated, motorized, hand cranked, battery, solar, electric (AC/DC), purge bulb, or a simple syringe. Any of the following means to facilitate movement of the infusion material from the infusion tank through the tubing into the fluid mold can be achieved through this fluid mold pump: compressed air, vacuum, suction, negative pressure, positive pressure, siphon, ballast, temperature actuators, or gravity feed.

compression tool 500 is a fixed or removable tool that facilitates the mechanical advantage to form and compress the smoking materials within the smoking paper around the fluid chamber mold. There are three embodiments for the compression tool: essential, magnetic, and automated. In its most essential embodiment, the compression tool is a cylindrical rod specified to a length, diameter, inside diameter, outside diameter, wall thickness, materials, appropriate for the smoking vessel. It can also have silicone end caps for paper protection and cleanability. In its magnetic embodiment, the compression tool is comprised of rare earth magnets with determined polarity to facilitate a break-away action when the compressed material has reached maximum compaction. In its automated embodiment, the compression tool is equipped with onboard sensors and metered material dispensing with a secure twist lock transfer connection and storage hopper to allow for safe and secure transfer between various stages. The automated compression tool also has programable pressure sensors with haptic feedback signal when optimal material compression is achieved. The automated compression tool can be further equipped with an on/off button, a sensor light, an alarm, or a light indicator. Such technology is known and understandable to a person of ordinary skill in the art.

cylindrical compression tool 520 is the compression tool in its most basic, yet essential embodiment. It is a cylindrical rod specified to a length, diameter, inside diameter, outside diameter, wall thickness, materials to match the sizes of the smoking vessels. As previously stated, the sizes of the smoking vessels are generally known by the person of ordinary skill in the art.

silicone end caps 522 are for protection and cleanability of the smoking vessels, specifically smoking papers.

magnetic compression tool 530 is comprised of rare earth magnets with determined polarity to facilitate a break-away action when the compressed material has reached maximum compaction.

automated compression tool 540 is a tool which facilitates the coalescence of smoking materials within the smoking paper without the need to manual urge materials or remove the compression tool while filling and compressing the organic smokable material.

twist lock transfer connection 542 is a point which allows for safe and secure transfer of material from the automated compression tool to the smoking vessel.

storage hopper 544 is a place where the smokable materials are held in the automated compression tool, prior to dispersion into the smokable vessel.

programmable pressure sensors 546 with haptic feedback signal are included in the automated compression tool to indicate when optimal material compression has been achieved.

On/Off Button/sensor light/alarm/light indicator 548 is included in the automated compression tool to alert the user when optimal material compression has been achieved.

The embodiments of the present invention comprise a forming and filling device for assembling smoking papers with smoking materials that possesses a centerline fluid chamber mold, more specifically described below. The invention, through embodiments, is an alternative to the pack and twist assembly of smoking papers with smoking materials that may be encouraged or to coalesce in such a manner ultimately preventing an enjoyable experience. Variables exist in smoking materials and methods and the assembly of hand-made smoking devices can affect the flavor and performance. Hand rolling smoking devices is a well-known practice, though it may be much more accurate to characterize it as an art. Well-made hand-rolled smoking devices require a considerable degree of skill and dexterity. Most hand-rolled smoking devices rarely embody the elegant symmetry of mass manufactured smoking devices, and their appearance is not the only thing that suffers; the smoking experience itself can be compromised, particularly because smoking material may be compacted in varying degrees within the paper wrapper column along its length, thus creating an uneven density of the smoking materials, and thereby adversely affecting active and free combustion rates and temperatures. That, in turn, can adversely affect the smoke flavors and result in the generation of unwanted combustion byproducts during the material burn.

Mass manufactured smoking devices, although visually appealing, suffer from variables in materials and assembly methods which results in unpredictable results, and waste. This can result in an un-smokable device, wasted money and time. Our system and filling methods mitigate human or process error over traditional filling devices. Burns slow, even, and the user is in control.

Material Dispenser combined with Compression Tool-A tool that facilitates transfer of smoking materials and assembly of a smoking device(s) from a tray, surface, table to a longer-term storage container. The tool can have micro motor(s) to facilitate and urge smoking materials into the smoking device vessel for the purposes of rapid dispensing of smoking materials, which increases usability. One embodiment locates a grinding mechanism in the dispenser reservoir. One embodiment positions a pressure sensor and haptic feedback to measure compression pressure exerted.

Mass manufactured smoking devices, although visually appealing, suffer from variables in materials and assembly methods which results in unpredictable results, and waste. This can result in an un-smokable device, wasted money and time. Our system and filling methods mitigate human or process error over traditional filling devices. Burns slow, even, and the user is in control.

One embodiment example is a suspension collar, including a fill line.

A second embodiment example is the suspension collar of the previous example, further including a scoop.

A third embodiment example is a fluid chamber mold system for use with a smoking vessel, comprising: the smoking vessel including a filter tip and an open end, a fluid chamber mold in the centerline of the smoking vessel oriented through the filter tip of the smoking vessel and towards the open end of the smoking vessel such that the smokable material may be compressed around the fluid chamber mold in the centerline of the smoking vessel, for airflow through a fluid chamber in the centerline of the compressed smokable material once the fluid chamber mold has been removed through the open end of the smoking vessel.

A fourth embodiment example is the fluid chamber mold system of the third embodiment, further comprising: the smoking vessel is a smoking paper.

A fifth embodiment example is the fluid chamber mold system of the fourth embodiment, further comprising: the smoking vessel is a conical smoking paper.

A sixth embodiment example is the fluid chamber mold system of the fifth embodiment, further comprising: the fluid chamber mold has a channeled shape.

A seventh embodiment example is the fluid chamber mold system of the sixth embodiment, further comprising: the channeled shape of the fluid chamber mold is a star or square shape.

An eighth embodiment example is the fluid chamber mold system of the seventh embodiment, further comprising: a suspension collar including a fill line and a scoop.

A ninth embodiment example is the fluid chamber mold system of the fifth embodiment, further comprising: the fluid chamber mold includes a pointed end for inserting through the filter tip of the conical smoking paper.

A tenth embodiment example is the fluid chamber mold system of the ninth embodiment, further comprising: the fluid chamber mold has a fluid mold stabilizer to hold the fluid chamber mold on the filter tip.

An eleventh embodiment example is the fluid chamber mold system of the fourth embodiment, further comprising: the fluid chamber mold has an infusion transfer.

A twelfth embodiment example is the fluid chamber mold system of the eleventh embodiment, further comprising: the infusion transfer has an infusion channel.

A thirteenth embodiment example is the fluid chamber mold system of the twelfth embodiment, further comprising: the infusion channel is an internal bore with infusion holes.

A fourteenth embodiment example is the fluid chamber mold system of the thirteenth embodiment, further comprising: the infusion holes are a smaller diameter at the filter tip side of the smoking vessel than at the open end of the smoking vessel.

A fifteenth embodiment example is the fluid chamber mold system of the fourteenth embodiment, further comprising: the infusion transfer includes a fluid mold pump, the fluid mold pump includes an infusion tank containing an infusion material, a fluid mold tubing connecting the infusion tank to the fluid chamber mold by fluid mold connectors.

A sixteenth embodiment example is the fluid chamber mold system of the fourth embodiment, further comprising: a compression tool that fits inside the diameter of the smoking vessel and around the fluid chamber mold in order to pack the smokable material.

A seventeenth embodiment example is the fluid chamber mold system of the sixteenth embodiment, further comprising: the compression tool is a magnetic compression tool of cylindrical break-away magnets.

An eighteenth embodiment example is the fluid chamber mold system of the sixteenth embodiment, further comprising: the compression tool is an automated compression tool.

A nineteenth embodiment example is the fluid chamber mold system of the nineteenth embodiment, further comprising: the automated compression tool includes an automated insertion and removal action for the fluid chamber mold.

A twentieth embodiment example is a method for using the fluid chamber mold system of the nineteenth embodiment, comprising the steps of: taking a plurality of smoking vessels and orienting them in a uniform plane such that the filter tips are oriented together and the open ends are oriented together in the uniform plane, inserting the fluid chamber molds on the centerline of the smoking vessels, inserting smokable materials into the smoking vessels, activating a plurality of automated compression tools to pack the smokable materials to a compressed smokable material to a predetermined tolerance, performing an optional infusion transfer step, and removing the fluid chamber molds to leave a fluid chamber in the centerline of the plurality of smoking vessels filled with compressed smokable material.

The methods described represent this invention in its most essential form. The scalability from single fill to multi-fill/commercial is seamless. By example, a method for assembling a single-fill smoking vessel includes: removing the filling and material tools from the material management transfer/storage 700, preparing smokable materials 440 to a coarseness that yields the required size of broken-down plant material to an acceptable size and shape tolerances for the intended smoking vessel based on preferred methods. Smoking materials coarseness can be approximated through mechanical separation using commercially available or cobbled means, such as: Hand separation, purpose-built hand grinders, graters, drills, crushers, pulverizes, mills, mortars, smashers, mashers, electric grinders, spice and coffee grinders, blenders, or purpose built commercial grinders.

In a particular method embodiment of using the system, the user then picks up the smoking paper in either the left or right hand from the filter tip, and also picks up the suspension collar in the opposite hand. The user slides the suspension collar into the opening end of the smoking paper, and slides slide the paper around the outside diameter of the suspension collar, to the engineered line of demarcation on the suspension collar. The user then picks up the fluid chamber mold and with the other hand pick up the preformed paper by the filter tip and inserts the fluid chamber mold, from tapered end, through the center of the filter tip and slides the fluid chamber mold to the leading edge of the suspension collar and secure the fluid mold stabilizer around the bottom of the filter tip. Holding the paper against the suspension collar with two fingers, the user begins scooping and urging smoking materials into the smoking papers while continue to hold the paper and the suspension collar. The user fills the smoking vessel with smoking materials to an initial level of ⅓ (one third) of the total internal volume and each subsequent fill is in ⅓'s (one third's) increments and agitates the suspension collar with a snapping finger motion, as well as the filter tip as necessary to encourage coalescence of smoking materials of the internal void. The user then threads the compression tool over the fluid mold and securely holds the suspension collar and paper firmly while ensuring fluid mold is centered. The user then begins compressing the material using a smooth, slow downward motion and ensures adequate compaction and manually void gaps in smoking materials, if any. The user repeats the above filling and packing steps until the compacted smoking materials are at a desired level but no more than the bottom leading edge of the suspension collar. The user then removes the suspension collar, holds the completed smoking vessel by the filter tip and with the other hand slowly draws the fluid chamber mold down to just below the top level of compacted smoking materials while lightly pinching the smoking paper and folding over the excess paper. With the other hand, using two fingers, incorporate a twisting motion, and begin kneading the smoking materials, further compressing the materials and working out any imperfections. Once the column is fully compressed, remove the fluid chamber mold from the open end. Tap the finished filter tip on a surface to encourage evacuation of any loose materials. Trim excess paper whip at the top.

Infusion options: Remove Infusion tools from the Material Transfer Tool. Connect the infusion fluid mold pump to the fluid mold tubing. Some embodiments eliminate the need for the fluid mold tubing and connect the infusion fluid mold directly to the fluid mold pump. Some embodiments use a metered automatic pump. Some versions of the metered automatic pump may be constructed in a series or have multiple pump stations in order to infuse more than one smoking device at a time.

Using a hand- or mechanical means infusion options: Encourage the transport of infusion material to flow from the fluid mold pump through the system to infiltrate the infusion fluid mold, diffusing out the fluid mold infusion port to impart the smokable materials with liquid concentrate. The total volume in ml/mg of concentrate to dispense per smoking device will depend on; the moisture content of smokable materials, the material coarseness, the vessel of choice, density of compressed smoking materials. Initial studies indicate a suitable range of 0.05 ml-1.0 mL. Disconnect the Fluid mold pump from the tubing and infusion fluid mold. Store all infusion tools back in the Material transfer tool.

Assisted Material Compression Tool: an embodiment of the Material compression tool that promotes material coalescence and maximum compaction of smoking materials. Using the roller or motorized compression actuator to extend the assisted compression tool to the indicated demarcation on the tool. The initial extension length is dependent on specifications of the smoking paper and tool can be adjusted accordingly. Thread assisted material compression tool over the fluid mold. Depress the mechanical or electronic button to engage dispensing of material. Material will dispense in metered increments and automatically begin the coalesce motors. Allow gravity and the mass of the tool to engage the material for a specified period of time to prepare materials for compression. Then begin applying gentle pressure to the smoking materials, slowly increasing the pressure until the internal sensors indicate the ideal tolerances have been achieved. Retract the compression tool to the previous fill setting. Using the roller or motorized compression actuator. Retract the assisted compression tool to the indicated demarcation on the tool. Press the mechanical or electronic button to engage dispensing of material. Material will dispense in metered increments and automatically begin the coalesce motors. Allow gravity and the mass of the tool to engage the material for a specified period of time to prepare materials for compression. Then begin applying gentle pressure to the smoking materials, slowly increasing the pressure until the internal sensors indicate the ideal tolerances have been achieved. Repeat until the full column of compressed smoking materials to the indicated level. Remove the suspension collar. Hold the completed smoking device by the filter tip. With the other hand slowly draw the fluid mold down to just below the top level of compacted smoking materials. Lightly pinch the smoking paper and fold over the excess paper. With the other hand, using two fingers, incorporate a twisting motion, and begin kneading the smoking materials, further compressing the materials and working out any imperfections. Once the column is fully compressed remove the fluid chamber mold from the open end. Tap the finished filter tip on a surface to encourage evacuation of any loose materials. Trim excess paper whip at the top.

Multi-Fill/Commercial variations: raise the fluid mold array platform using the mechanical or electronic actuator. Screw on the specified version and quantity of fluid molds (Regular, Infusion, specialty shapes). Thread the smoking papers over all of the fluid molds on the array base. Lower the fluid mold platform using the mechanical or electronic actuator allowing the conical wrappers to occupy the smoking paper cavity shells. Assemble the appropriate number of automatic material dispenser/compression tools. Open the material dispenser closures located at the top of the material dispenser/compression tool. Fill material management transfer/storage tool with smoking materials. Connect and fill material dispenser/compression tools with smoking materials, using the universal connection fitting from material management transfer/storage tool. Secure the material dispenser/compression tool closure. Fully retract the compression tool using the mechanical or electronic actuators. Snap each dispenser/compression tool onto the assembly array. By guiding the dispenser/compression array into the inside diameter of the smoking papers resting in the smoking paper cavities, ensure the papers are engaged to the suspension collar, securely against the smoking paper cavity shell. Ensure the cones are perpendicular and straight with no wrinkles, creases, or rips. This process mimics the suspension bridge created in the hand process. Locate the dispensing actuator button on the material dispenser compression tool and press to dispense a metered amount of smoking materials into the conical smoking paper. Lower the compression tool using the mechanical or electronic actuators. The internal motors will begin the coalescence of smoking materials. The mass of the dispenser/compression array should be sufficient compression, inspect the compaction and address any visible issues. Once ideal compaction has occurred at each layer the motors will provide haptic feedback to signal when to proceed with the next compression layer. The process is repeated until the level of the compressed smoking materials reaches the indicated fill line. Remove dispenser/compression array, inspect filled smoking devices. Raise the fluid mold array platform using the mechanical or electronic actuator.

Infusion Option for Multi-Fill/Commercial variations: Remove the automatic dispenser and compression tool set from the array. Gather needed Infusion tools from the Material Transfer Tool. Using the metered infusion pump, turn on to start warming, dial in the desired amount of infusion concentrate to dispense. Connect the pump to the infusion fluid mold. Either leave smoking devices on the array or unseat the fluid molds from the array platform. Do not remove the fluid mold from the filled smoking devices. Connect the infusion fluid mold pump to the fluid mold tubing. Some embodiments eliminate the need for the fluid mold tubing and connects the infusion fluid mold directly to the fluid mold pump. Some embodiments use a metered automatic pump. Some versions of the metered automatic pump may be constructed in a series or have multiple pump stations in order to infuse more than one smoking device at a time. Press the infusion button on the metered infusion pump to initiate the transport of infusion materials. Once the pump stops, turn off. Remove pump from fluid mold. Remove completed smoking device from the fluid mold array if they are still attached. Finish off the smoking vessel by automated or mechanical means known to a person of ordinary skill in the art. Otherwise, hold the completed smoking device by the filter tip. With the other hand slowly draw the fluid mold down to just below the top level of compacted smoking materials. Lightly pinch the smoking paper and fold over the excess paper. With the other hand, using two fingers, incorporate a twisting motion, and begin kneading the smoking materials, further compressing the materials and working out any imperfections. Once the column is fully compressed remove the fluid chamber mold from the open end. Tap the finished filter tip on a surface to encourage evacuation of any loose materials. Trim excess paper whip at the top.

What is claimed is:

1. A fluid chamber mold system for use with a smoking vessel, configured to be placed prior to addition of smokable material comprising:

the smoking vessel including a filter tip and an open end, a fluid chamber mold in the centerline of the smoking vessel oriented through the filter tip of the smoking vessel and towards the open end of the smoking vessel such that the smokable material may be compressed around the fluid chamber mold in the centerline of the smoking vessel, for airflow through a fluid chamber in the centerline of the compressed smokable material once the fluid chamber mold has been removed through the open end of the smoking vessel.

2. The fluid chamber mold system of claim 1, further comprising:

the smoking vessel is a smoking paper.

3. The fluid chamber mold system of claim 2, further comprising:

the smoking vessel is a conical smoking paper.

4. The fluid chamber mold system of claim 3, further comprising:

the fluid chamber mold has a channeled shape.

5. The fluid chamber mold system of claim 4, further comprising:

the channeled shape of the fluid chamber mold is a star or square shape.

6. The fluid chamber mold system of claim 5, further comprising:

a suspension collar which fits inside the open end of the smoking vessel, the suspension collar including a scoop and a fill line for the smokable material.

7. The fluid chamber mold system of claim 3, further comprising:

the fluid chamber mold includes a pointed end for inserting through the filter tip of the conical smoking paper.

8. The fluid chamber mold system of claim 7, further comprising:

the fluid chamber mold has a fluid mold stabilizer to hold the fluid chamber mold on the filter tip.

9. The fluid chamber mold system of claim 2, further comprising:

the fluid chamber mold has an infusion transfer.

10. The fluid chamber mold system of claim 9, further comprising:

the infusion transfer has an infusion channel.

11. The fluid chamber mold system of claim 10, further comprising:

the infusion channel is an internal bore with infusion holes.

12. The fluid chamber mold system of claim 11, further comprising:

The infusion transfer has an infusion channel.

13. The fluid chamber mold system of claim 12, further comprising:

the infusion transfer includes a fluid mold pump, the fluid mold pump includes an infusion tank containing an infusion material, a fluid mold tubing connecting the infusion tank to the fluid chamber mold by fluid mold connectors.

14. The fluid chamber mold system of claim 2, further comprising:

a compression tool that fits inside the diameter of the smoking vessel and around the fluid chamber mold in order to pack the smokable material.

15. The fluid chamber mold system of claim 14, further comprising:

the compression tool is a magnetic compression tool of cylindrical break-away magnets.

16. The fluid chamber mold system of claim 14, further comprising:

the compression tool is an automated compression tool.

17. The fluid chamber mold system of claim 16, further comprising:

the automated compression tool includes an automated insertion and removal action for the fluid chamber mold.

18. A method for using the fluid chamber mold system of claim 17, comprising the steps of:

taking a plurality of smoking vessels and orienting them in a uniform plane such that the filter tips are oriented together and the open ends are oriented together in the uniform plane, inserting the fluid chamber molds on the centerline of the smoking vessels, inserting smokable materials into the smoking vessels, activating a plurality of automated compression tools to pack the smokable materials to a compressed smokable material to a predetermined tolerance, performing an optional infusion transfer step, and removing the fluid chamber molds to leave a fluid chamber in the centerline of the plurality of smoking vessels filled with compressed smokable material.

19. A method of adding smokable material to a smoking vessel, comprising the steps of:

picking up the smoking vessel in either a left or right hand from a filter tip;

picking up a suspension collar in the opposite hand;

sliding the suspension collar into an opening end of the smoking vessel;

picking up a fluid chamber mold for use with a smoking vessel, configured to be placed in a centerline of the smoking vessel prior to the insertion of smokable material;

placing the fluid chamber mold in the centerline of the smoking vessel oriented through a filter tip of the smoking vessel and towards the open end of the smoking vessel such that a smokable material may be compressed around the fluid chamber mold in the centerline of the smoking vessel for airflow through a fluid chamber in the centerline of the compressed smokable material once the fluid chamber mold has been removed through the open end of the smoking vessel;

holding the smoking vessel towards the open end of the smoking vessel between the suspension collar and at least two fingers;

adding a portion of the smokable material into the open end of the smoking vessel;

agitating the suspension collar as well as the filter tip to encourage coalescence of smokable material;

using a compression tool on the smokable material and around the fluid chamber mold while securely holding the suspension collar and paper;

repeating the addition of another portion of the smokable material into the open end of the smoking vessel, agitation of the suspension collar and the filter tip to encourage coalescence of smokable material, and using the compression tool on the smokable material and around the fluid chamber mold while securely holding the suspension collar and paper until desired compression of smokable material is achieved to the desired level.

* * * * *